US006524782B1

(12) United States Patent
Suzuki

(10) Patent No.: US 6,524,782 B1
(45) Date of Patent: Feb. 25, 2003

(54) METHOD FOR PREPARING SILVER HALIDE EMULSION AND SILVER HALIDE PHOTOGRAPHIC MATERIAL BY USE OF PREPARATION

(75) Inventor: Tetsuya Suzuki, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/370,544

(22) Filed: Aug. 9, 1999

(30) Foreign Application Priority Data

Aug. 11, 1998 (JP) ..... 10-226855

(51) Int. Cl.[7] ..... G03C 1/005
(52) U.S. Cl. ..... 430/567; 430/569
(58) Field of Search ..... 430/567, 569

(56) References Cited

U.S. PATENT DOCUMENTS

| | | | | |
|---|---|---|---|---|
| 4,334,012 A | * | 6/1982 | Mignot | 430/567 |
| 5,028,516 A | | 7/1991 | Mukunoki et al. | |
| 5,587,276 A | | 12/1996 | Katoh | |
| 5,627,020 A | * | 5/1997 | Hahm et al. | 430/569 |
| 5,780,209 A | | 7/1998 | Yamashita | |
| 5,972,588 A | * | 10/1999 | Nabeta | 430/567 |

FOREIGN PATENT DOCUMENTS

| | | | |
|---|---|---|---|
| EP | 0581200 | | 2/1994 |
| EP | 0845706 | | 3/1998 |
| JP | 2-124563 | * | 5/1990 |
| JP | 8-262628 | * | 10/1996 |

OTHER PUBLICATIONS

European Search Report EP 99 30 6292.

* cited by examiner

*Primary Examiner*—Janet Baxter
*Assistant Examiner*—Amanda C. Walke
(74) *Attorney, Agent, or Firm*—Jordan B. Bierman; Bierman, Muserlian and Lucas

(57) ABSTRACT

Preparation method of a silver halide emulsion is disclosed, in which the silver halide emulsion contains tabular grains having a mean equivalent circle diameter of 0.1 to 10.0 $\mu$m, a mean grain thickness of 0.01 to 0.3 $\mu$m and an aspect ratio of 1.5 to 300, the emulsion is prepared by a process comprising: (a) forming the tabular silver halide grains in the presence of fine silver halide grains containing at least a metal selected from the group of indium, gallium and metals in Groups 8, 9 and 10 of the periodical table and (b) subjecting the tabular silver halide grain emulsion to ultrafiltration to remove a salt-containing solution from a reaction mixture solution in the growth process of the tabular grains.

7 Claims, 1 Drawing Sheet

Figure 1:
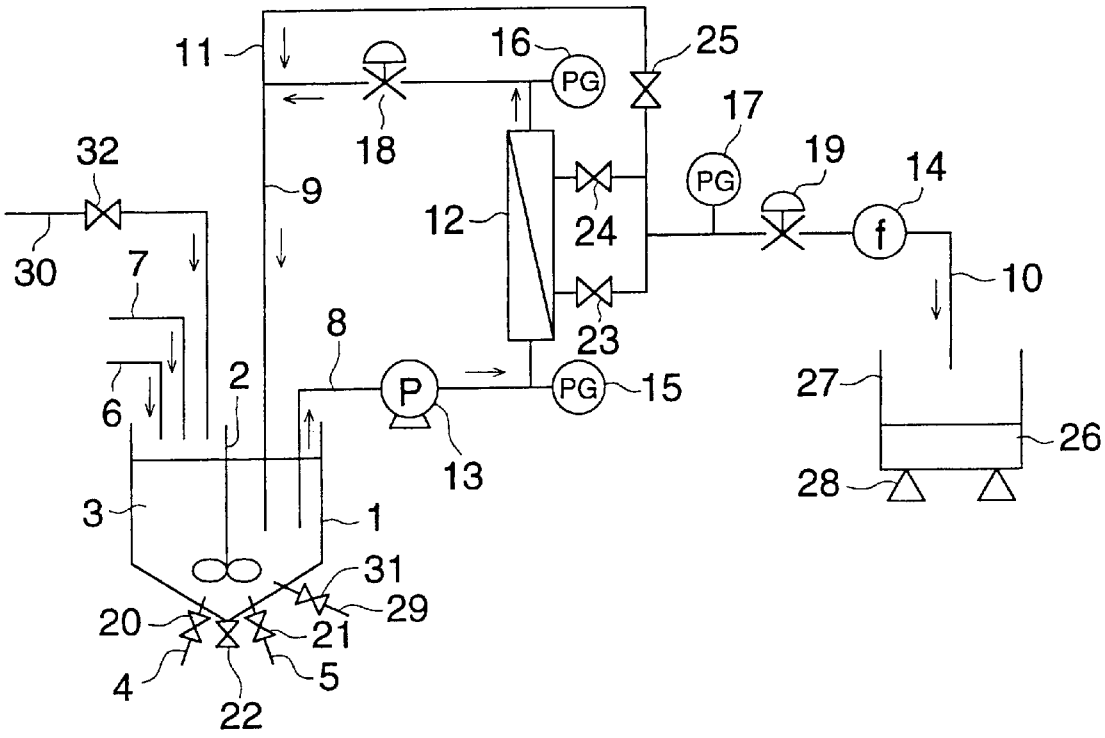

METHOD FOR PREPARING SILVER HALIDE EMULSION AND SILVER HALIDE PHOTOGRAPHIC MATERIAL BY USE OF PREPARATION

FIELD OF THE INVENTION

The present invention relates to a method for preparing a silver halide emulsion used in silver halide photographic light sensitive materials, and a silver halide photographic light sensitive material by the use of the silver halide emulsion.

BACKGROUND OF THE INVENTION

Recently, reduction of processing effluent of silver halide photographic light sensitive materials (hereinafter, also denoted simply as photographic materials) from the viewpoint of environment protection and saving space. As means for reducing the processing effluent has been known reduction of the silver coating weight of a photographic material so as to enable to process the photographic material at low replenishing rates. However, simply reducing the silver coating weight resulted in reduction in an optical density or sensitivity, so that the use of tabular silver halide grain emulsions has been known in the photographic art.

There have been disclosed methods for preparing tabular silver halide grains (hereinafter, also denoted simply as tabular grains) and techniques of using the tabular grains, as described in U.S. Pat. Nos. 4,434,226, 4,439,520, 4,414,310, 4,434,048, 4,414,306 and 4,459,353; JP-A 59-99433 and 62-20944 (herein, the term, JP-A means a unexamined and published Japanese Patent Application). It is well known that tabular grains have advantages, such as enhanced sensitivity including enhanced spectral sensitization efficiency due to a sensitizing dye, improvements in sensitivity/granularity ratio, enhanced sharpness due to a specific optical property of the tabular grains and enhanced covering power. On the other hands, tabular grains have a disadvantage such that pressure defect easily occurs due to thin thickness of the tabular grains. In rapid processing for use in clinical photography by using an automatic processor, for example, pressure defects in wet state, which is called roller marks and caused by transporting rollers of the processor in a processing solution, easily occur. As a technique for enhancing pressure resistance is known a technique of allowing metals of the 8th group of the periodical table to be doped in the interior of tabular grains. It was proved that it was unexpectedly difficult to allow such metals to be occluded in a desired position within the tabular grain, leading to reduced sensitivity and enhanced fogging.

Designation of rapid processable photographic materials with tabular grains by decreasing the coating weight of binder and silver resulted in such a defect that uneven development easily occurred.

Hardeners are conventionally contained in a developer for use in rapid access. The hardeners are such aldehyde types as glutar aldehyde, which are apprehensive for not only order but also effects on human body. Recently, concerns about environmental matter increase so that urgent improvements desired. However, rapid processing with a developer containing no hardener resulted in not only marked deterioration in roller marks and uneven development, but also processing fault, such as dye stain due to sensitizing dyes remaining in the photographic material.

SUMMARY OF THE INVENTION

Accordingly, an object of the present invention is to provide a method for preparing a silver halide tabular grain emulsion, which exhibits high sensitivity and produces no roller mark even when subjected to rapid processing at low replenishing rates, and a silver halide photographic material in which uneven development and stain due to remained sensitizing dye, even when developed in a developer containing no hardener.

The object of the present invention described above can be accomplished by the following constitution:

a method of preparing a silver halide emulsion, wherein said silver halide emulsion comprises tabular grains exhibiting a mean equivalent circle diameter of 0.1 to 10.0 $\mu$m, a mean grain thickness of 0.01 to 0.3 $\mu$m and an aspect ratio of 1.5 to 300, the method comprising:

(a) reacting a silver salt solution and a halide salt solution to perform silver halide grain nucleation, followed by silver halide grain growth to form the tabular grains, wherein the tabular grains are formed in the presence of fine silver halide grains containing at least one selected from the group of gallium, indium and metals in Groups 8, 9 and 10 of the periodical table;

the method further comprising:

(b) removing a solution containing soluble salts from a reaction mixture solution by ultrafiltration during the silver halide grain growth to reduce the volume of the reaction mixture solution in a reaction vessel.

DETAILED DESCRIPTION OF THE INVENTION

The tabular silver halide grains according to the present invention are prepared in the presence of fine silver halide grains containing at least one selected from the group consisting of gallium, indium and atoms in Group 8, 9 and 10 of the periodical table, including their ions or complexes.

Preparing tabular silver halide grains in the presence of the fine silver halide grains means that at least one selected from the group consisting of gallium, indium, and atoms in Group 8, 9 and 10 of the periodical table or their ions or complexes has been allowed to be contained (or doped) in fine silver halide grains, and using the fine silver halide grains, the metal-doping into the tabular grains is performed.

The metals of gallium, indium, Group 8 (Fe, Ru, Os), Group 9 (Co, Rh, Ir) and Group 10 (Ni, Pd, Pt) in the form of an atom, ion or complex ion (hereinafter, Groups 8, 9 and 10 are also collectively referred to as Group VIII).

Compounds contained in the fine silver halide grains are preferably metal complexes comprised of a metal ion of the Group VIII and ligand(s). In specific, preferred form, it is contemplated to employ as a dopant a hexacoordinate metal complex satisfying the following formula:

$$[MeL_6]^n$$

wherein Me is filled frontier orbital polyvalent metal ion, preferably, $Fe^{+2}$, $Ru^{+2}$, $Os^{+2}$, $Co^{+3}$, $Rh^{+3}$, $Ir^{+3}$, $Pd^{+4}$ or $Pt^{+4}$; $L_6$ represents six coordinate complex ligands which can be independently selected, provided that at least four of the ligands are anionic ligands and at least one (preferably at least three and more preferably at least four) of the ligands is more electronegative than any halide ligands; and n is −2, −3 or −4. More preferably, the ligands represented by $L_6$ contain one to six $CN^-$.

Specific examples of dopants capable of providing shallow electron traps are shown below:

| | |
|---|---|
| SET-1 | $[Fe(CN)_6]^{4-}$ |
| SET-2 | $[(Ru(CN)_6]^{4-}$ |
| SET-3 | $[(Os(CN)_6]^{4-}$ |
| SET-4 | $[Rh(CN)_6]^{3-}$ |
| SET-5 | $[Ir(CN)_6]^{3-}$ |
| SET-6 | $[Fe(hydrazine)(CN)_5]^{4-}$ |
| SET-7 | $[RuCl(CN)_5]^{4-}$ |
| SET-8 | $[OsBr(CN)_5]^{4-}$ |
| SET-9 | $[RhF(CN)_5]^{4-}$ |
| SET-10 | $[IrBr(CN)_5]^{3-}$ |
| SET-11 | $[FeCO(CN)_5]^{3-}$ |
| SET-12 | $[RuF_2(CN)_4]^{4-}$ |
| SET-13 | $[OsCl_2(CN)_4]^{4-}$ |
| SET-14 | $[RhI_2(CN)_4]^{4-}$ |
| SET-15 | $[IrBr_2(CN)_4]^{4-}$ |
| SET-16 | $[Ru(CN)_5(OCN)]^{4-}$ |
| SET-17 | $[Ru(CN)_5(N_3)]^{4-}$ |
| SET--18 | $[Os(CN)_5(SCN)]^{4-}$ |
| SET--19 | $[Rh(CN)_5(SeCN)]^{3-}$ |
| SET-20 | $[Ir(CN)_5(HOH)]^{2-}$ |
| SET-21 | $[Fe(CN)_3Cl_3]^{3-}$ |
| SET-22 | $[Ru(CO)_2(CN)_4]^{2-}$ |
| SET-23 | $[Os(CN)Cl_5]^{4-}$ |
| SET-24 | $[Co(CN)_6]^{3-}$ |
| SET-25 | $[Ir(CN)_4(oxalate)]^{3-}$ |
| SET-26 | $[In(NCS)_6]^{3-}$ |
| SET-27 | $[Ga(NCS)_6]^{3-}$ |

It is additionally contemplated to employ oligomeric coordinate complexes in a silver halide emulsion to increase sensitivity, as taught by Evans et al. U.S. Pat. No. 5,024,931.

The dopants are effective in conventional concentrations, where concentrations are based on the total silver of finally formed tabular silver halide grains. Preferably dopants are contemplated to be incorporated in concentrations of at least $1\times10^{-6}$ mol per silver mol up to their solubility limit, typically not more than $5\times10^{-4}$ mol per silver mol. Specifically preferred concentrations are in the range of from about $10^{-5}$ to $10^{-4}$ mol per silver mol.

Metal compounds contained in fine silver halide grains which are used in the tabular silver halide grains, are incorporated through solution in water or organic solvents such as methanol and acetone. The metal compounds may be employed in the form of a potassium salt. Occlusion of the metal compound into the fine silver halide grains can be determined in such a way that the fine grains are separated by the centrifugation and the metal contained in the supernatant or the separated fine grains is identified by the atomic absorption analysis. To stabilize the solution, a hydrogen halide solution (e.g., HCl, HBr, etc.) or an alkali halide (e.g., KCl, NaCl, KBr, KI, etc.) may be further added thereto. Acids or alkalis may optionally be added. The metal compound may be added to a reaction vessel prior to fine grain formation or added to the reaction mixture during the ine grain formation. The metal compound which is added to a soluble silver salt solution or an alkali halide solution (e.g., NaCl, KBr, KI, etc.), is continuously added during the fine grain formation. These soluble silver salt and alkali halide solutions are independently prepared and may continuously be added at a time during the fine grain formation. These addition methods may be employed singly or in combination.

The position (or the time) of adding the metal-containing fine silver halide grains to the host tabular grain emulsion is not specifically limited, and may be any time during tabular grain formation or chemical ripening.

Silver halide grains comprise silver chloride, silver bromide, silver iodide, silver chlorobromide, silver iodochloride, silver iodobromide or silver iodochlorobromide.

Preferably, scarcely water-soluble, fine silver halide grains are added to the host tabular grain emulsion described above. The expression "scarcely water-soluble silver halide grains" means that they are more water-scarcely soluble than the host tabular grains, in terms of halide composition. The composition thereof may be any of silver iodide, silver iodobromide, silver iodochloride and silver chlorobromide. Conventionally, the size of the fine silver halide grains are preferably in the range of from 0.01 to 0.1 $\mu$m, and grains with not less than 0.01 $\mu$m or more than 0.1 $\mu$m may be employed. The fine silver grain emulsion can be prepared by the known method. The fine silver halide grain emulsion can be added at any time before completion of the final host tabular grain formation. The fine silver halide grain are not needed to be instantaneously dissolved, and are desirably dissolved to be disappeared. After adding the fine, sparingly water-soluble silver halide grains to the host tabular gain emulsion, silver bromide or silver iodobromide are allowed to be grown thereon, and preferably, dislocation lines are introduced.

The preparation apparatus used in the invention is one capable of preparing silver halide emulsions, comprising a reaction vessel in which silver halide grains are formed, pipe lines for adding various solutions used for forming silver halide grains and a mechanism for stirring a reaction mixture solution, and further comprising a mechanism for concentrating the reaction solution to control the mean intergrain distance during grain growth. The concentrating mechanism may be provided within the reaction vessel, and is preferably connected to the reaction vessel via pipe(s). The reaction solution is circulated, by means of a mechanism for circulating the reaction solution, between the reaction vessel and circulation mechanism at an arbitrary (controllable) flow rate. The circulating solution can be stopped at an arbitrary time. The apparatus further comprises a means for determining the amount of a salt-containing solution withdrawn from the reaction solution by the concentrating mechanism, and provided with a mechanism for arbitrarily controlling the amount of the solution withdrawn. The apparatus may be optionally provided with other functions.

In general, the process of preparing a silver halide grain emulsion comprises the nucleation stage (comprising formation of nucleus grains and ripening of the nucleus grains), followed by the growth stage of growing the nucleus grains. Alternatively, nucleus grains (or seed grains) which were prepared in advance may be allowed to grow separately. The grain growth may further be comprised of two or more stages, such as a first growth stage, second growth stage, etc. The growth process of silver halide grains according to the invention include an overall process from after formation of the nucleus grains to the time of completion of the grain growth. The time of starting the grain growth refers to starting point of the grain growth process.

The mean intergrain distance refers to a mean value of distances between grains, and specifically a mean value of spatial distances between the centers of gravity of grains in the reaction mixture solution (silver halide emulsion) during the process of preparing a silver halide emulsion. In other words, assuming that all growing grains are equally spaced from each other in the reaction mixture solution, the mean intergrain distance is the edge length of a cube having the same volume as the space occupied by the grain. More specifically, the mean intergrain distance is defined by the following equation:

$$\text{Mean intergrain distance}=(\text{Volume of the reaction mixture solution/number of grains in the reaction mixture solution})^{1/3}$$

In the growth process of silver halide grains, the volume of the reaction mixture solution contained in the reaction vessel is increased along with grain growth mainly by addition of silver and halide salt solutions used for growing grains, resulting in an increase of the mean intergrain distance. In the apparatus for preparing a tabular silver halide grain emulsion used in the invention, an increase of the mean intergrain distance along with grain growth is restrained, which enables maintaining a desired mean intergrain distance or reducing it. Herein, the expression, "maintain a desired mean intergrain distance" refers to the state of keeping a specified mean intergrain distance for at least 10 sec.

The mean intergrain distance of the tabular silver halide grains at the growth stage is dependent on the volume of the reaction solution (silver halide emulsion) in the process of growing tabular silver halide grains. Taking account of the yield of a silver halide emulsion, the mean intergrain distance is maintained to preferably be 1.15 or less times that at the start of the grain growth. On the other hand, when the mean intergrain distance is decreased in the process of growing tabular silver halide grains, the aspect ratio decreases. Specifically, in cases where the mean intergrain distance is less than 0.6 times that at the start of the grain growth, a marked decrease of the aspect ratio occurs, and an advantageous feature in photographic performance of tabular silver halide grains is lowered. Thus, the mean intergrain distance in the process of growing tabular silver halide grains used in the invention is preferably within not less than 0.60 times and not more than 1.15 times that at the start of the grain growth, more preferably from 0.60 to 1.10 times and still more preferably from 0.60 to 1.05 times. The mean intergrain distance at the start of the grain growth is preferably 1.5 $\mu$m or more, more preferably between 1.8 $\mu$m and 4.0 $\mu$m and still more preferably between 2.0 $\mu$m and 3.5 $\mu$m. Presuming that the number of silver halide grains is substantially unchanged during the grain growth, the mean intergrain distance being within 0.6 to 1.15 times that at the start of growing means that the volume of the reaction solution is maintained, during the grain growth, within 0.22 to 1.52 times that at the start of growing. In other words, the grain growth is undergone with optimally withdrawing a salt containing solution from the reaction solution through an ultrafiltration membrane so that the volume of the reaction solution is not less than 0.22 times and not more than 1.52 times that at the start of growing. Herein, the flow rate of the salt containing solution separated from the reaction solution through an ultrafiltration membrane is denoted as a permeation flux.

The control of the intergrain distance during the growth of tabular silver halide grains used in the invention is intended to both enhance photographic performance of a silver halide emulsion and to enhance yield of the emulsion. Therefore, enhancement of the emulsion yield accompanied with deteriorated photographic performance is not intended. In cases where the mean intergrain distance at the start of growing grains is less than 1.5 $\mu$m, a marked decrease of the aspect ratio occurs with concentration, as shown in the inventive emulsion of Examples of JP-A 6-67326, in which the mean intergrain distance is ca. 1.1 $\mu$m. Such a decrease of the aspect ratio often results in undesirable photographic performance.

One example of the embodiments of the preparation apparatus of a silver halide emulsion according to the invention, in which the mean intergrain distance can be controlled and maintained during grain growth, will be explained by reference to FIG. 1. The reaction vessel 1 initially contains a dispersing medium 3. The apparatus comprises the reaction vessel 1, which is provided with a silver salt addition line 4 for adding a silver salt aqueous solution (preferably, a silver nitrate aqueous solution), a halide addition line 5 for adding an aqueous halide solution (preferably, an alkaline metal bromide, iodide or chloride aqueous solution), and addition lines 29 and 30 for adding a metal-containing, fine silver halide grain emulsion used in the invention. The apparatus further comprises a dispersing medium addition line 6 for adding a dispersing medium and a water addition line 7 for adding water The reaction vessel is further provided with a mechanism 2 for stirring a dispersing medium and a reaction solution (a mixture of a dispersing medium and silver halide grains). The stirring mechanism may be any of the conventional types. The silver salt solution is added into the reaction vessel through the silver salt addition line 4 at a flow rate controlled by a silver addition valve 20. The halide solution is added into the reaction vessel through the halide addition line 5 at a flow rate controlled by a silver addition valve 21. The metal-containing, fine silver halide emulsion is added into the reaction vessel through lines 29 and 30 at a flow rate controlled by valves 31 and 32 for adding fine grain emulsion. The solutions may be added, through the silver salt addition line 4 and halide addition line 5, onto the surface of the reaction solution and preferably below the surface of the reaction solution, specifically, in the vicinity of the stirring mechanism 2. The metal-containing, fine silver halide grain emulsion may be added, through the silver salt addition line 30, onto the surface of the reaction solution or may be added below the surface of the reaction solution. The stirring mechanism 2 mingles the silver salt and halide solutions and the metal-containing, fine silver halide grain emulsion with the dispersing medium, enabling to form silver halide host grains.

In the first stage of formation of silver halide i.e. the nucleation stage is formed a dispersion (reaction solution) containing nucleus grains, optionally followed by the ripening stage. Thereafter, addition of the silver salt and halide solutions is further continued, being transferred to the second stage of the silver halide formation i.e. the growth stage, in which additional silver halide, produced as a reaction product deposit onto the nucleus grains to increase the grains in size. In the process of forming grains by adding the silver salt and halide solutions into the reaction vessel according to the invention, a portion of the reaction solution in the reaction vessel is sent by a circulation pump 18, through a liquid withdrawing line 8 (i.e. line for withdrawing the reaction mixture solution) to an ultrafiltration unit 12 with monitoring by pressure gauge 15 and is returned to the reaction vessel through a liquid returning line 9 (i.e., line for returning the reaction mixture solution). In this case, a portion of a soluble salt solution contained in the reaction solution is separated through an ultrafiltration unit 12 by adjusting pressure applied to the ultrafiltration unit with a pressure adjusting valve 18 and pressure gauge 16 which are provided in the way of the liquid returning line, and is drained through permeating solution draining line 10. Thereby, even in the process of forming grains with adding silver salt and halide solutions into the reaction vessel, the grain formation with arbitrarily controlling the intergrain distance becomes feasible.

When applying this method in the invention, it is preferred that the permeation flow rate of the soluble salt solution separated through the ultrafiltration membrane (i.e. permeation flux; also referred to as ultrafiltration flux) is arbitrarily controlled. For example, the ultrafiltration flux can be arbitrarily controlled using a flow rate-adjusting valve 19 and a pressure gauge 17 provided in the course of a permeating solution drain line 10. In this case, to minimize variation in pressure of the ultrafiltration unit 12, a permeating solution-returning line 11 may be employed by opening a valve 25 provided in the course of the permeating solution-returning line. Or the permeating solution returning line may not be employed by closing the valve 25; it can be selected, depending on the operation conditions (herein 23 and 24 indicate valves). The ultrafiltration flux can be detected by using a flow meter 14 provided in the course of the permeating solution drain line 10, or detected from variation in weight of the drained permeating solution 26, by using a permeating solution receiving vessel 27 and a balance 28.

In the invention, concentration by means of ultrafiltration may be carried out continuously or intermittently during the course of grain growth. In applying the ultrafiltration in the grain growth process, after circulation of the reaction solution to the ultrafiltration stage is started, the circulation preferably continues at least until completion of the grain formation. Therefore, even when the concentration is interrupted, it is preferred to continue the circulation of the reaction solution to the ultrafiltration unit. This is because of avoiding the difference in grain growth between grains in the reaction vessel and those in the ultrafiltration stage. Further, it is preferred to make the circulating flow rate through the ultrafiltration stage sufficiently high. Concretely, a residence time in the ultrafiltration unit including withdrawing and returning lines of the reaction solution is preferably 30 sec or less, more preferably 15 sec. and still more preferably 10 sec. or less. The volume of the ultrafiltration stage including the solution withdrawing line 8, returning line 9, ultrafiltration unit 12, a circulating pump 13 and pressure gauges 15 and 16 is preferably 30% or less of the volume of the reaction vessel, more preferably 20% or less and still more preferably 10% or less. Finally, the reaction mixture solution is drained through solution draining valve 22.

Thus, the volume of total silver halide reaction solution can be arbitrarily reduced, during grain formation, by applying the ultrafiltration stage, as described above. In addition, the volume of the silver halide reaction solution can be kept constant at a given value by adding water from an addition line 7.

Ultrafiltration modules and circulating pumps s which can be employed in performing the ultrafiltration according to the invention, are not limited, but it is preferable to avoid materials and structure which act on a silver halide emulsion to adversely affect photographic performance. Further, a differential molecular weight of an ultrafiltration membrane used in the ultrafiltration module can be optionally selected. For example, in cases where removing, during grain growth, a dispersing medium such as gelatin contained in a silver halide emulsion or a compound employed in preparation of the grains, there can be selected an ultrafiltration membrane having a molecular weight cut-off more than the molecular weight of the objective material. In cases where such material is not intended to be removed, on the contrary, an ultrafiltration membrane having a lower differential molecular weight than the molecular weight of the material is selected.

The ultrafiltration membrane is representatively an anisotropic membrane comprised of an extremely thin, microporous membrane provided on a thick, porous membrane. Useful membranes are selected from the group of a variety of polymeric materials including polyvinyl chloride, polyvinyl carboxylic acid, polyvinyl formic acid, polyvinyl acetate, polyvinyl alcohol, polysilfone, polyvinyl ether, polyacrylamide, polyimide, polyester, polufluoroalkylene (e.g., polytetrafluoroethylene), polyfluorovinylidene, and cellulose polymers such as cellulose and cellulose ester (e.g., cellulose acetate.

Tabular silver halide grains are crystalographically classified as a twinned crystal. The twinned crystal is one having one or more twin planes within the grain. Classification of the twin crystal forms in silver halide grains is detailed in Klein and Moisar, "Photographishe Korrespondents" vol. 99, page 99 and ibid vol. 100, page 57. Tabular grains relating to the invention are those having two or more parallel twin planes with the grain. The twin planes are present in parallel to a plane having the largest area among planes constituting the surface of the tabular grain which is called the major face). The preferred form in the invention is one having two parallel twin planes.

The aspect ratio according to the invention is referred to as a ratio of equivalent circular diameter of the grain to its thickness (i.e. aspect ratio diameter/thickness). The equivalent circular diameter refers to a circle having an area equal to the projected area when the grain is projected in the direction vertical to the major face. The mean equivalent circular diameter of tabular silver halide grains used in the invention is preferably 0.1 to 10.0 $\mu$m, more preferably 0.3 to 5.0 $\mu$m, and still more preferably 0.3 to 2.0 $\mu$m. The mean thickness of the tabular grains used in the invention is preferably 0.01 to 0.3 $\mu$m, more preferably 0.05 to 0.25 $\mu$m, and still more preferably 0.07 to 0.2 $\mu$m.

The equivalent spherical diameter refers to a diameter of a sphere having a volume equal to that of the silver halide grain. The grain thickness refers to the thickness in the direction vertical to the major faces and in general, is equal to the distance between the major faces. The grain projected area for calculating the equivalent circular diameter and equivalent spherical diameter and the thickness can be determine according to the following manner. A sample, on a support is prepared by coating latex balls of a known diameter as an internal standard and silver halide grains so that their major faces are oriented in the direction parallel to the support surface. After subjected to shadowing from an angle by carbon vacuum evaporation, a replica sample is prepared according to a conventional replica method. An electron micrograph of the sample is taken and the projected are and thickness of each grain can be determined using an apparatus such as an image processing device. In this case, the grain projected area can be calculated from the projected area of the internal standard and the grain thickness, from shadow lengths of the internal standard and the grain. In the invention, mean values of the aspect ratio, equivalent circular diameter, grain thickness and equivalent spherical diameter each are an arithmetic average of values determined by measuring at least 500 grains contained in the emulsion.

The coefficient of variation of the equivalent spherical diameter of silver halide grains is a value as defined below. The coefficient of variation of the equivalent spherical diameter of silver halide grains according to the invention is preferably 0.2 or less, more preferably 0.15 or less and still more preferably 0.1 or less.

Coefficient of variation of the equivalent spherical diameter=(standard deviation of equivalent spherical diameter)/(mean equivalent spherical diameter).

Similarly can be determined a coefficient of variation of the equivalent circular diameter, as defined below. The coefficient of variation of the equivalent circular diameter of silver halide grain according to the invention is preferably 0.2 or less, more preferably 0.15 or less and still more preferably 0.1 or less.

Coefficient of variation of equivalent circular diameter=(standard deviation of equivalent circular diameter)/(mean equivalent circular diameter)

Preferably at least 50% of the total grain projected area of the emulsion according to the invention is accounted for by tabular grains having an aspect ratio of from 1.5 to 300, more preferably at least 50% of the total grain projected area of the emulsion according to the invention is accounted for by tabular grains having an aspect ratio of 3 to 50, and still more preferably at least 50% of the total grain projected area of the emulsion according to the invention is accounted for by tabular grains having an aspect ratio of 5 to 25. At least 80% of the total grain projected area of the emulsion according to the invention is preferably accounted for by tabular grains relating to the invention.

The tabular grains relating to the invention each have one or more parallel twin planes within the grain. Preferably at least 50% (more preferably at least 80%) of the tabular grains relating to the invention is accounted for by those having two parallel twin planes within the grain. The twin plane(s) can be observed by transmission electron microscopy, for example, in the following manner. A silver halide emulsion is coated on a support so that the major faces of the grains are oriented in the direction parallel to the support, to form a sample. The sample is repeatedly cut vertically to the support with a diamond cutter to obtain thin slices with a thickness of ca. 0.1 $\mu$m. The presence position of the twin planes can be confirmed by observing the slices with a transmission electron microscope.

The composition of silver halide grains relating to the invention is preferably silver iodobromide, silver bromide, silver chlorobromide, or silver iodochlorobromide. Of these is preferably silver iodobromide grain emulsion having an average iodide content of 2 mol % or less, more preferably 0.01 to 1.5 mol %, and 0.05 to 1.2 mol %. The halide composition of silver halide grains can be determined in EPMA method or X-ray diffraction analysis.

An average iodide content of the surface phase of silver halide grains relating to the invention is preferably 2 mol % or less, more preferably 0.005 to 1.0 mol % and still more preferably 0.01 to 0.5 mol %. The average iodide content of the surface phase of silver halide grains is one determined by the XPS method or ISS method. The surface iodide content is determined, for example, by the XPS method, as follows. A sample is cooled to −155° C. or lower under ultra-high vacuum at $1\times10^{-4}$ torr or less, exposed to Mg Ka line as probe X-rays at a source current of 40 mA, and measurement is made with respect to Ag 3d5/2, and Br 3d, and I 3d3/2 electrons. Integral intensities of measured peaks are corrected with a sensitivity factor and from these intensities can be determined the composition such as an iodide content of the silver halide surface phase.

In a silver halide emulsion relating to the invention, distribution of the iodide content among grains is preferably more uniform. Thus, a coefficient of variation of the iodide content of grains of the silver halide emulsion is preferably 30% or less and more preferably 20% or less, wherein the coefficient of variation of the iodide content of grains is a standard deviation of the iodide content divided by a mean iodide content time 100(%) and can be obtained by measuring at least 500 grains contained in the silver halide emulsion.

Silver halide grains for photographic us e are microcrystals comprised of silver chloride, silver bromide, silver iodide or solid solution thereof. Two or more phases different in halide composition may be formed inside the crystal. As grains having such a structure are known grains comprised of an internal phase and an external phase which are different in halide composition, generally called core/shell type grains. Silver halide grains relating to the invention are preferably those having a core/shell structure in which the external phase contains iodide hither than the internal phase.

The silver halide grains relating to the invention can contain dislocation lines. The preferred location of the dislocation lines is in the vicinity of peripheral portions, edges or corners of tabular grains. The dislocation lines are introduced preferably after 50% of the total silver, more preferably between 60% and 95%, and still more preferably between 70% and 90%.

A method for introducing the dislocation lines into the silver halide grain is optional. The dislocation lines can be introduced by various methods, in which, at a desired position of introducing the dislocation lines during the course of forming silver halide grains, an iodide (e.g., potassium iodide) aqueous solution are added, along with a silver salt (e.g., silver nitrate) solution and without addition of a halide other than iodide by a double jet technique, silver iodide fine grains are added, only an iodide solution is added, or a compound capable of releasing an iodide ion disclosed in JP-A 6-11781 (1994) is employed. Among these, it is preferable to add iodide and silver salt solutions by a double jet technique, or to add silver iodide fine grains or an iodide ion releasing compound, as an iodide source.

Efficiency of introducing the dislocation lines into silver halide emulsion grains can be enhanced by using the preparation apparatus according to the invention. For example, the mean intergrain distance at the time of introducing the dislocation lines into the grains is controlled to be preferably within not less than 0.60 times and not more than 1.00 times that at the start of the grain growth and more preferably from 0.60 to 0.80 times that at the start of the grain growth. More concretely, the mean intergrain distance at the time of introducing the dislocation lines into the grains is controlled to be preferably not more than 3.2 $\mu$m, more preferably not more than 2.8 $\mu$m and still more preferably not less than 0.9 $\mu$m and not more than 2.0 $\mu$m.

The dislocation lines in tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that causes dislocation in the grains, and they are placed on a mesh for electron microscopy. The sample is observed by transmission electron microscopy, while being cooled to prevent the grain from being damaged (e.g., printing-out) by electron beam. Since electron beam penetration is hampered as the grain thickness increases, sharper observations are obtained when using an electron microscope of high voltage type. From the thus-obtained electron micrograph can be determined the position and number of the dislocation lines in each grain.

To the preparation of the silver halide emulsion relating to the invention can be optimally applied a variety of the methods known in the art, including the controlled double jet method and controlled triple jet methods, in which the pAg of the reaction solution is controlled during the course of the grain formation. There can be optionally employed a silver halide solvent, including ammonia, thioethers and thioureas. The thioureas are referred to U.S. Pat. Nos. 3,271,151, 3,790,387 and 3,574,626. Further, the silver halide emulsion can be prepared in an ammoniacal precipitation, neutral precipitation or acidic precipitation. The emulsion is preferably formed under environment at a pH of 5.5 or less, and more preferably 4.5 or less, in terms of restraining fog during the grain formation.

The silver halide emulsion relating to the invention contains a dispersing medium with silver halide grains. The dispersing medium is a compound having protective colloidal property to silver halide grains. It is preferred to cause the dispersing medium to be present over a period from nucleation until completion of the grain growth. Examples of the preferred dispersing medium used in the invention include gelatin and protective colloidal polymers. Preferred gelatin includes alkali-processed or acid-processed gelatin conventionally having a molecular weight of ca. 100,000, low molecular weight gelatin with a molecular weight of 5,000 to 30,000 and oxidized gelatin. Oxidized gelatin, low molecular weight gelatin and oxidized low molecular weight gelatin are preferably employed specifically in the nucleation stage.

To precisely control the halide composition within a grain or among grains, at least one portion of an iodide containing phase of the grain can be formed by supplying iodide containing silver halide fine grains. Similarly at least one portion of an iodide containing phase of the grain can be formed in the presence of silver halide grains having a solubility lower than that the grain. The silver halide grains having a lower solubility is preferably silver iodide fine grains.

To silver halide emulsions relating to the invention are applicable techniques described in Research Disclosure No. 308119 (herein after, denoted as RD 308119).

The silver halide emulsion relating to the invention can be subjected to physical ripening, chemical ripening and spectral sensitization, according to the procedure known in the art. Additives used therein are described in RD 17643, RD 18716 and RD 308119, as shown below.

In the silver halide photographic light sensitive material used in the invention, at least one of hydrophilic colloidal layers (including a silver halide emulsion layer) preferably contains a compound represented by formula (1):

Formula (1)

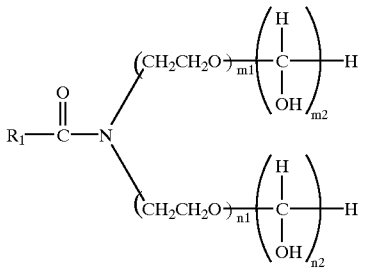

wherein $R_1$ represents a substituted or unsubstituted alkyl, alkenyl or aryl group, each containing 1 to 30 carbon atoms; m1 and n1 each are 1 to 50; and m2 and n2 each are 0 to 3.

The compound represented by formula (1) will be further described. In the formula (1), $R_1$ represents a substituted or unsubstituted alkyl, alkenyl or aryl group, each containing 1 to 30 carbon atoms, and preferably a substituted or unsubstituted alkyl or alkenyl group, each containing 5 to 20 carbon atoms; m1 and n1, which may be the same or different, each is 1 to 50, preferably 1 to 30; and m2 and n2, which may be the same of different, each is 0 to 3, preferably 0. Further, m1 plus n1 is preferably 5 to 40, more preferably 5 to 30.

Exemplary compounds represented by formula (1) are shown below.

1-1

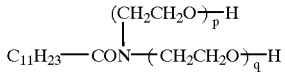

p+q=5

1-2

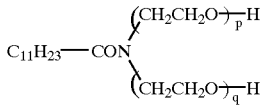

p+q=10

1-3

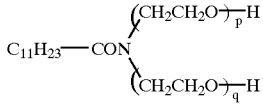

p+q=15

1-4

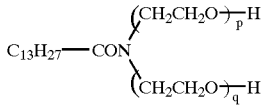

p+q=20

1-5

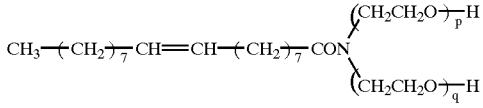

p+q=30

1-6

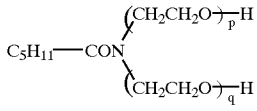

p+q=10

1-7

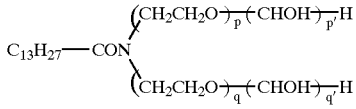

p+q=30
p'+q'=30

The compound represented by formula (1) is not incorporated into a specific layer, but preferably incorporated into a hydrophilic colloidal layer provided furthest from the support. The amount thereof is preferably 1 mg/m$^2$ to 1.0 g/m$^2$, and more preferably 10 mg/m$^2$ to 100 mg/m$^2$.

In the silver halide photographic light sensitive materials used in the invention, at least one of the hydrophilic colloidal layers preferably contains a compound represented by formula (2):

Formula (2)

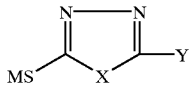

where X represents an oxygen or sulfur atom; Y represents a hydrogen atom or a substituent; M represents a hydrogen atom, an alkali metal ion, a quaternary ammonium ion or a quaternary phosphonium ion.

The compounds represented by formula (2) will be further described. In the formula (2), X represents a oxygen or sulfur atom, and Y represents a hydrogen atom or a substituent. Examples of the substituent include a straight-chained, branched or cyclic alkyl group having 1 to 10 carbon atoms, an aryl group having 6 to 10 carbon atoms, a mercapto group, a straight-chained or branched alkylthio group having 6 to 10 carbon atoms, an acyloxy group having 1 to 10 carbon atoms, amino group, an alkylamino group having 1 to 10 carbon atoms, a carbonamido group having 2 to 10 carbon atoms, a sulfonamido group having 1 to 10 carbon atoms, an oxycarbonylamino group having 2 to 10 carbon atoms, a ureido group having 1 to 10 carbon atoms, an acyl group having 2 to 10 carbon atoms, an oxycarbonyl group having 2 to 10 carbon atoms, a carbamoyl group having 1 to 10 carbon atoms, a sulfonyl group having 1 to 10 carbon atoms, a sulfinyl group having 1 to 10 carbon atoms, sulfamoyl group, carboxy group (including its salt), and a sulfo group (including its salt). These groups may further be substituted by a substituent, including an alkyl, aryl, heterocycle, hydroxy, alkoxy, alkylthio, amino, alkylamino, carbonamido, sulfonyl, carboxylic acid (including its salt), or sulfonic acid (including its salt) group.

These substituents will be further detailed. The alkyl group is straight-chained, branched or cyclic one having 1 to 10 carbon atoms (preferably 1 to 5 carbon atoms), which may further be substituted by a substituent such as described as substituents for Y, e.g., methyl, ethyl, propyl, isopropyl, butyl, t-butyl, hydroxymethyl, etc. The aryl group is one having 6 to 10 carbon atoms, which may be substituted by a substituent such as ones for Y described above, e.g., phenyl, o-carboxyphenyl, o-sulfophenyl, etc. The heterocyclic group 5- or 5-membered ring containing carbon, nitrogen, oxygen, or sulfur atom, including furyl, benzofuryl, pyrrolyl, imidazolyl, pyrazolyl, piperazyl, pyridyl, thienyl, isothiazolyl, pyrrolidinyl, piperadinyl and morpholyl , which may be substituted by a substituent such as ones for Y described above, e.g., imidazolyl, pyrrolidinyl, morpholyl, etc.

The alkoxy group is one having 1 to 10 carbon atoms (preferably 1 to 5 carbon atoms), which may be substituted by a substituent, such as ones for Y, e.g., methoxy, ethoxy, propoxy, butoxy, pentyloxy, 2-hydroxyethoxy, etc. The alkylthio group is one having 1 to 10 carbon atoms (preferably 1 to 5 carbon atoms), which may be substituted by a substituent, such as ones for Y, e.g., methylthio, carboxymethylthio, 2-dimethylaminoethylthio, 2-sulfoethylthio, etc. The alkylamino group is one having 1 to 10 carbon atoms (preferably 1 to 6 carbon atoms), which may be substituted by a substituent, such as ones for Y, e.g., methylamino, dimethylamino, diethylamino, diisopropylamino, dibutylamino, dicarboxymethylamino, dicaroxyethylamino, etc. The carbonamido group is one having 1 to 60 carbon atoms, which may be substituted by a substituent, such as ones for Y, e.g., acetoamido, propioneamido, etc. The sulfonyl group is one having 1 to 5 carbon atoms, such as methanesulfonyl, which may be substituted.

The alkyl group represented by Y of formula (2) is preferably one having 1 to 5 carbon atoms, which may be substituted by a substituent, such as ones for Y, preferably hydroxy, amino, alkylamino, carboxy and sulfo. Preferred examples thereof include methyl, ethyl, butyl, i-propyl, hydroxymethyl, carboxymethyl, sulfomethyl, hydroxyethyl, carboxyethyl, 1,2-dicarboxyethyl, sulfoethyl, carboxypropyl, sulfopropyl, carboxybutyl, aminomethyl, dimethylaminomethyl, diethylaminomethyl, dimethylaminoethyl and diethylaminoethyl. The aryl group represented by Y of formula (2) is preferably a phenyl group, which may be substituted by a substituent such as ones for Y. Preferred examples thereof include phenyl, p-methylphenyl, anisyl, p-carboxyphenyl, p-sulfonylphenyl and p-acetoamidophenyl, each of which may be substituted.

The alkylthio group represented by Y of formula (2) is preferably one having 1 to 6 carbon atoms, which may be substituted by a substituent, such as ones for Y, preferably heterocyclic group, hydroxy, alkoxy, alkylthio, amino, alkylamino, sulfonyl, carboxyl (including its salt) and sulfo (including its salt). Examples thereof include methylthio, ethylthio, benzylthio, hydroxyethylthio, carboxymethylthio, sulfomethylthio, carboxyethylthio, 1,2-dicarboxyethylthio, sulfoethylthio, 1-carboxypropylthio, sulfopropylthio, sulfobutylthio, ethoxyethylthio, aminomethylthio, dimethylaminomethylthio, diethylaminomethylthio, aminoethylthio, methylaminoethylthio, dimethylaminoethylthio, diethylamino-ethylthio, diisopropylaminoethylthio, dimethylaminopropylthio, dimethylaminobutylthio, dimethylaminohexylthio, 2-imidazolyl-ethylthio, 2-pyrrolydinylethylthio, 2-piperazinylthio, 2-morpholinoethylthio and methanesulfonylethylthio, each of which may further be substituted. The arylthio group represented by Y of formula (2) is preferably a phenylthio group, which may be substituted by a substituent, such as substituents for Y. Examples thereof include phenyl thio, p-carboxyphenylthio and p-sulfonylphenylthio. The acyloxy group represented by Y of formula (2) is preferably one having 1 to 5 carbon atoms, such as acetoxy. The alkylamino group is preferably one having 1 to 5 carbon atoms, such as methylamino, dimethylamino, and diethylamino. The carbonamido group is preferably one having 2 to 7 carbon atoms, such as acetoamido, and benzamido. The sulfonamido group is preferably one having 1 to 6 carbon atoms, such as methanesulfonamido and benzenesulfonamido. The oxycarbonylamino group is preferably one having 1 to 7 carbon atoms, such as methoxycarbonylamino and phenoxycarbonylamino. The ureido group is preferably one having 1 to 7 carbon atoms, such as methylureido and phenylureido. The acyl group is preferably one having 1 to 6 carbon atoms, such as acetyl and benzoyl. The oxycarbonyl group is preferably one having 1 to 7 carbon atoms, such as methoxycarbonyl and phenoxycarbonyl. The carbamoyl group is preferably one having 1 to 6 carbon atoms, such as carbamoyl. The sulfonyl group is preferably one having 1 to 6 carbon atoms, such as methanesulfonyl. The sulfinyl group is preferably one having 1 to 6 carbon atoms, such as methanesulfinyl. The sulfamoyl group is preferably one having 1 to 6 carbon atoms, such as sulfamoyl and diethylsulfamoyl. These groups may be further substituted.

In formula (2), the alkali metal represented by M includes lithium, sodium and potassium; and the quaternary ammonium includes ammonium and trimethylammonium.

Of the compounds represented by formula (2) is specifically preferred a compound represented by the following formula (2-1):

Formula (2-1)

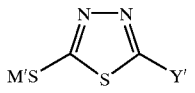

wherein Y' and M' each are the same as defined in Y and M of formula (2). Specifically, Y' is preferably alkyl, mercapto, alkylthio, amino or alkylamino,and more preferably alkylthio. These groups may further be substituted by a substituent, such as a heterocyclic group, hydroxy, alkoxy, alkylthio, amino, alkylamino, carboxy (including its salt)

and sulfo (including its salt); preferably amino, alkylamino and carboxy. These substituent may further be substituted by a substituent, such as substituents for Y described above.
Preferred and Exemplary compounds represented by formula (2) are shown below, but are not limited to these examples.
A-1
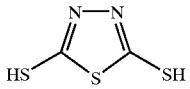
A-2
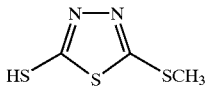
A-3
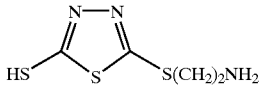
A-4
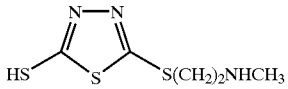
A-5
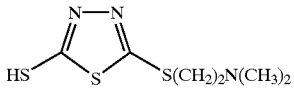
A-6
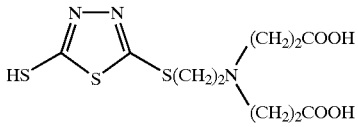
A-7
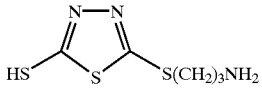
A-8
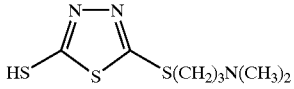
A-9
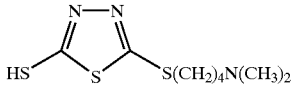
A-10
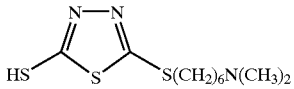
A-11
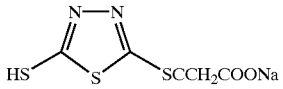
A-12
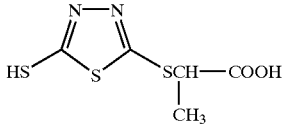
A-13
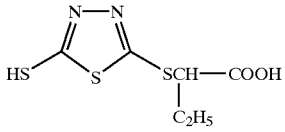
-continued
A-14
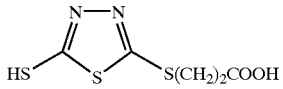
A-15
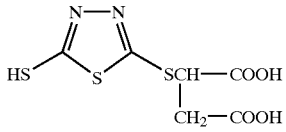
A-16
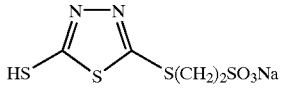
A-17
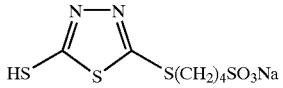
A-18
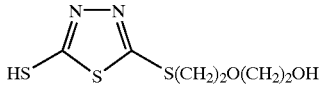
A-19
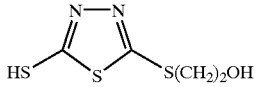
A-20
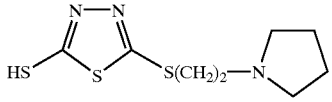
A-21
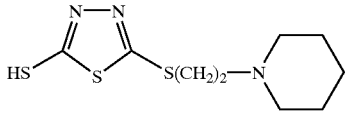
A-22
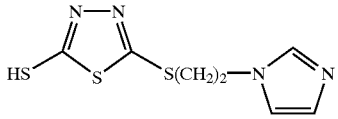
A-23
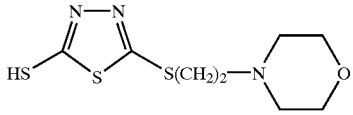
A-24
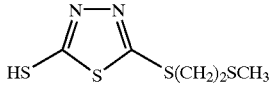
A-25
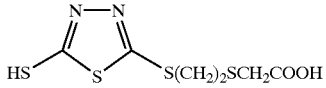
A-26
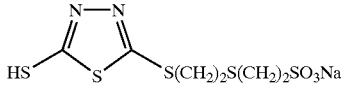
A-27
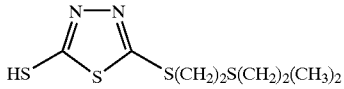

-continued
A-28
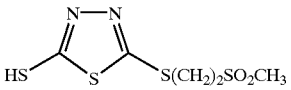
A-29
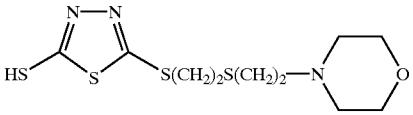
A-30
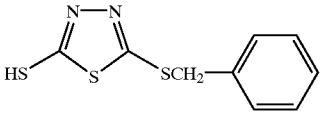
A-31
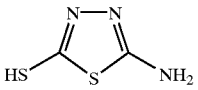
A-32
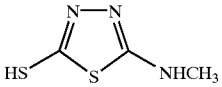
A-33
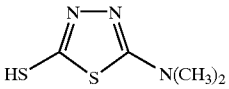
A-34
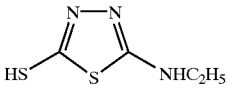
A-35
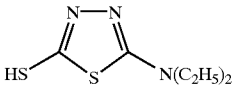
A-36
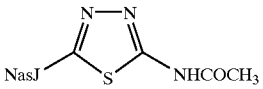
A-37
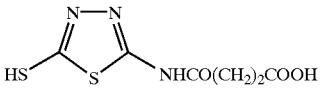
A-38
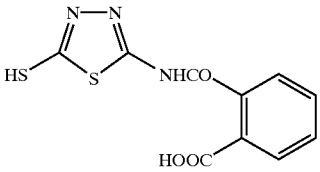
A-39
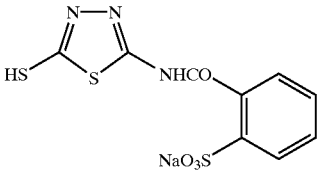
A-40
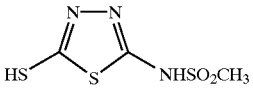
-continued
A-41
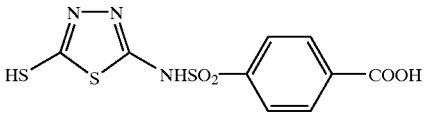
A-42
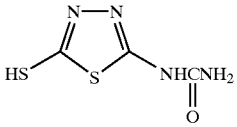
A-43
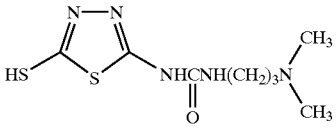
A-44
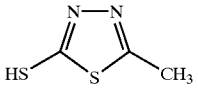
A-45
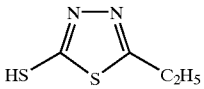
A-46
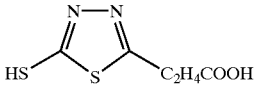
A-47
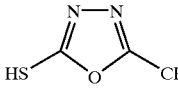
A-48
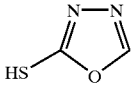
A-49
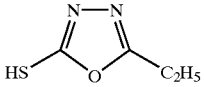
A-50
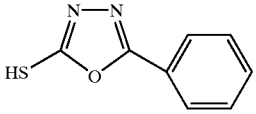
A-51
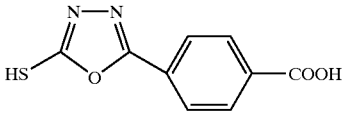
A-52
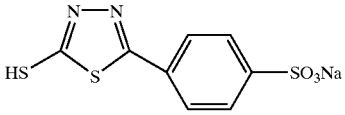
A-53
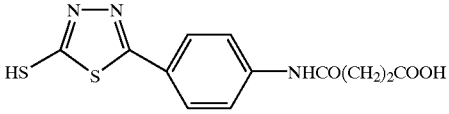
A-54
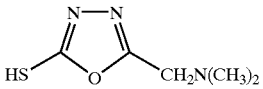

-continued

A-55

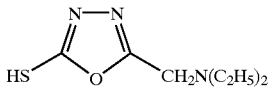

A-56

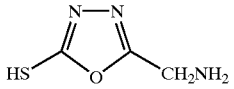

A-57

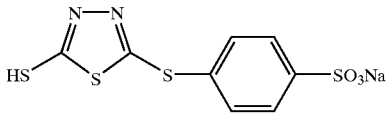

A-58

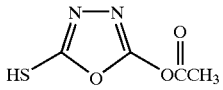

A-59

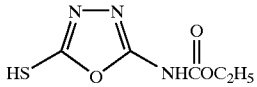

A-60

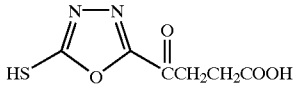

A-61

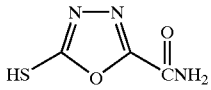

A-62

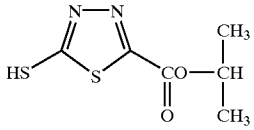

A-63

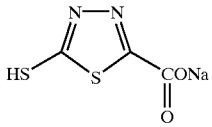

A-64

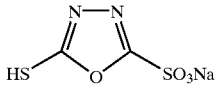

The compound represented by formula (2) can be readily synthesized according to the methods described in Advances in Heterocyclic Chemistry, vol. 9, 165–209; J. Am. Chem. Soc., vol. 44, 1502–1510; JP-A 55-59463, JP-B 49-8334 (herein, the term, JP-B means an examined, published Japanese Patent), U.S. Pat. No. 3,017,270, British Patent 940,169, and West German Patent 2,716,707. The compound represented by formula (2) is not incorporated into a specific layer, but preferably incorporated into a hydrophilic colloidal layer provided furthest from the support. The amount thereof is preferably 1 mg/m$^2$ to 1.0 g/m$^2$, and more preferably 10 mg/m$^2$ to 100 mg/m$^2$.

The silver halide photographic materials according to the invention can further employ adjuvants known in the photographic art, as described in Research Disclosures aforementioned.

The silver halide photographic materials used in the invention preferably contains a latex derived from an ethylenically unsaturated monomer containing an active methylene group.

The latex derived from an ethylenically unsaturated monomer containing an active methylene group will be further described. The latex derived from an ethylenically unsaturated monomer containing an active methylene group used in the invention may be any latex containing an active methylene group, and the preferred latex is represented by the following formula (3):

$$—(D)x—(A)y—(B)z— \qquad \text{Formula (3)}$$

wherein D represents a repeating unit derived from an ethylenically unsaturated monomer containing an active methylene group; A represents a repeating unit derived from an ethylenically unsaturated monomer other than D, provided that a homopolymer component corresponding to (A)y, exhibits a glass transition temperature of not more than 35° C.; B represents a repeating unit derived from an ethylenically unsaturated monomer, other than D and A described above; x, y and z, are percentage by weight of each polymeric component, and x is 0.5 to 40, y is 60 to 99.5, z is 0 to 50, and The ethylenically unsaturated monomer containing an active methylene group and represented by D is preferable one represented by the following formula (4)

$$CH_2{=}C(R^1)L^0—X \qquad \text{Formula (4)}$$

wherein $R^1$ represents a hydrogen atom, an alkyl group having 1 to 4 carbon atoms (e.g., methyl, ethyl, n-propyl, n-butyl), or a halogen atom (e.g., chlorine, bromine), preferably a hydrogen atom, methyl, or chlorine atom; $L^0$ represents a single bond or bivalent linkage group, such as one represented by the following formula:

$$—(L^1)m—(L^2)n—$$

wherein $L^1$ represents —CON($R^2$)—, in which $R^2$ represents a hydrogen atom, an alkyl group having 1 to 4 carbon atoms or a substituted alkyl group having 1 to 6 carbon atoms, —COO—, —NHCO—, —OCO—,

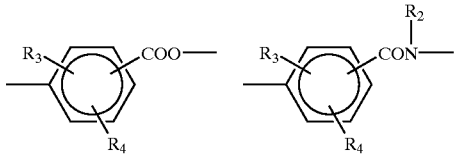

in which $R^3$ and $R^4$ independently represent a hydrogen atom, hydroxy, halogen atom, or an alkyl, alkoxy, acyloxy or aryloxy, each of which may be substituted or unsubstituted; $L^2$ represent a linkage group linking $L^1$ and X. The linkage group represented by $L^2$ is preferably represented by the following formula (5):

$$—[X^1—(J^1—X^2)p—(J^2—X^3)q—(J^3)r]s— \qquad \text{Formula (5)}$$

where $J^1$, $J^2$ and $J^3$, which may be the same or different, represent —CO—, —$SO_2$—, —CON($R^5$)—, —$SO_2$N($R^5$)—, —N($R^5$)—$R^6$—, —N($R^5$)—$R^6$—N($R^7$)—, —O—, —S—, —N($R^5$)—CO—N($R^7$)—, —N($R^5$)—$SO_2$N($R^7$)—, —COO—, —OCO—, —N($R^5$)$CO_2$— or —N($R^5$)CO—, in which $R^5$ represents a hydrogen atom, an alkyl group having 1 to 6 carbon atoms or substituted alkyl group having 1 to 6 carbon atoms; $R^6$ represents an alkylene group having 1 to 4 carbon atoms and $R^7$ represents a hydrogen atom, an alkyl group having 1 to 6 carbon atoms or substituted alkyl group having 1 to 6 carbon atoms); p, q, r and s each 0 or 1; $X^1$, $X^2$ and $X^3$, which may be the same or different, each represents a straight-chained or branched alkylene, an aralkylene or a phenylene group, each of which has 1 to 10 carbon atoms and may be substituted or unsubstituted. Examples of the alkylene group include methylene, methylmethylene, dimethylmethylene, dimethylene, trimethylene, tetramethylene, pentamethylene, hexamethylene and decylmethylene; Examples of the aralkylene group include benzylidene; and examples of the phenylene group include p-phenylene, m-phenylene and methylphenylene.

X represents a univalent group containing an active methylene group, and preferred examples thereof include $R^8$—CO—$CH_2$—COO—, CN—$CH_2$ —COO—, $R^8$—CO—$CH_2$—CO— or $R^8$—CO—$CH_2$—CON($R^5$)—, in which $R^5$ is the same as defined above, $R^8$ represents a substituted or unsubstituted alkyl group having 1 to 12 carbon atoms (e.g., methyl, ethyl, n-butyl, t-butyl, n-nonyl, 2-methoxyethyl, 4-phenoxybutyl, benzyl, 2-methanesulfonamidoethyl, etc.), substituted or unsubstituted aryl group (e.g., phenyl, p-methylphenyl, p-methoxyphenyl, o-chlorophenyl, etc.), substituted or unsubstituted alkoxy group (e.g., methoxy, ethoxy, methoxyethoxy, n-butoxy, etc.), substituted or unsubstituted cycloalkyloxy group (e.g., cyclohexyloxy), substituted or unsubstituted aryloxy group (e.g., phenoxy, p-methylphenoxy, o-chlorophenoxy, p-cyanophenoxy, etc.), substituted or unsubstituted amino group (e.g., amino, methylamino, ethylamino, dimethylamino, butylamino, etc.), NC—$CH_2$—COO—, $R^8$—CO—$CH_2$—CO— (in which $R^8$ is the same as defined above), $R^8$CO—$CH_2$—CON$R^5$— (in which R5 and R8 are the same as defined above).

In the polymer represented by formula (3), examples of the ethylenically unsaturated monomer containing an active methylene group and corresponding to the repeating unit D are shown below, but are not limited to these examples.

M-1 2-acetoacetoxyethyl methacrylate
M-2 2-acetoacetoxyethyl acrylate
M-3 2-acetoacetoxypropyl methacrylate
M-4 2-acetoacetoxypropyl acrylate
M-5 2-acetoacetoamidoethyl methacrylate
M-6 2-acetoacetoamidoethyl acrylate
M-7 2-cyanoacetoxyethyl methacrylate
M-8 2-cyanoacetoxyethyl acrylate
M-9 N-(2-cyanoacetoxyethyl)acrylamide
M-10 2N-propionylacetoxyethyl acrylate
M-11 N-(2-propionylacetoxyethyl)methacrylamide
M-12 N-4-(acetoactoxybenzyl)phenyl acrylamide
M-13 ethylacryloyl acetate
M-14 acryloylmethyl acetate
M-15 N-methacryloyloxymethylacetoacetoamide
M-16 ethylmethacryloyl acetoacetate
M-17 N-allylcyanoacetoamide
M-18 methylacryloyl acetoacetate
M-19 N-(2-methacryloyloxyethyl)cyanoacetoamide
M-20 p-(2-acetoacetyl)ethylstyrene
M-21 4-acetoacetyl-1-methacryloxylpiperazine
M-22 ethyl α-acetacetoxymethacrylate
M-23 N-butyl-N-acryloyloxyethylacetoacetoamide
M-24 p-(2-acetoacetoxy)ethylstyrene The ethylenically unsaturated monomer of a repeating unit represented by B in formula (1) is such a monomer that a homopolymer corresponding to the copolymerizing component (B)y of formula (1), exhibits a glass transition temperature of not more than 35° C. Examples thereof include an alkylacrylate (e.g., methyl acrylate, ethyl acrylate, n-butyl acrylate, n-butyl acrylate, n-hexyl acrylate, benzyl acrylate, 2-ethyl acrylate, iso-nonyl acrylate, n-dodecyl acrylate, etc.), an alkyl methacrylate (e.g., n-butyl methacrylate, n-hexyl methacrylate, 2-ethylhexyl methacrylate, iso-nonyl methacrylate, n-dodecyl methacrylate, etc.) and dines (e.g., butadiene, isoprene, etc.).

Of these is preferred a monomer such that a homopolymer corresponding to the copolymerizing component (A)y of formula (3), exhibits a glass transition temperature of not more than 10° C., and specifically preferred examples thereof include an alkyl acrylate containing an alkyl side chain having 2 or more carbon atoms (e.g., ethyl acrylate, n-butylacrylate, 2-ethylhexyl acrylate, iso-nonyl acrylate, etc.), an alkyl methacrylate containing an alkyl side chain having 6 or more carbon atoms (e.g., n-hexyl methacrylate, 2-ethylhexyl methacrylate) and dienes (e.g., butadiene, isoprene, etc.).

The glass transition temperature value of polymers is described in J. Brandrup and E. H. Immergut, Polymer Handbook Third Ed. (John Wiley & Sons, 1989), VI/page 209 to VI/page 277.

The ethylenically unsaturated monomer of a repeating unit represented by B of formula (3) represents a repeating unit except for A, and it is preferably a repeating unit derived from such a monomer that a homopolymer corresponding to the copolymerizing component (A)y of formula (3), exhibits a glass transition temperature of more than 35° C. Examples of such monomers include acrylic acid esters (e.g., t-butyl acrylate, phenyl acrylate, 2-naphthyl acrylate, etc.), methacrylic acid esters (e.g., methyl methacrylate, ethyl methacrylate, 2-hydroxyethyl methacrylate, benzyl methacrylate, 2-hydroxypropyl methacrylate, phenyl methacrylate, cyclohexyl methacrylate, cresyl methacrylate, 4-chlorobenzyl methacrylate, ethylene glycol dimethacrylate, etc.), vinyl esters (e.g., vinyl benzoate, pivaloyloxyethylene, etc.), acrylamides (e.g., acrylamide, methylacrylamide, ethylacrylamide, propylacrylamide, butylacrylamide, t-butylacrylamide, cyclohexylacrylamide, benzylacrylamide, hydroxymethylacrylamide, methoxyethylacrylamide, dimethylaminoethylacrylamide, phenylacrylamide, dimethylacrylamide, β-cyanoethylacrylamide, diacetone acrylamide, etc.), methacrylamides (e.g., methacrylamide, methylmethacrylamide, ethylmethacrylamide, propylmethacrylamide, butylmethacrylamide, t-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, etc.), styrenes (e.g., styrene, methylstyrene, dimethylstyrene, trimethylenestyrene, ethylstyrene, isopropylstyrene, chlorostyrene, methoxystyrene, acetoxystyrene, dichlorostyrene, bromstyrene, vinyl benzoic acid methyl ester, etc.), divinylbenzene, acrylonitriled methacrylonitrile, N-vinylpyrrolidone, N-vinyloxazolidonea chiorovinylidene, and phenyl vinyl ket one.

The polymer represented by formula (3) may be allowed to copolymerize with a monomer containing an anionic functional group (such as a carboxy group or sulfonic acid group), as described in JP-B 60-15935, 45-3822 and 53-28086, and U.S. Pat. No. 3,700, 456, to enhance stability of latex. Examples of such monomers include the following compounds: acrylic acid, methacrylic acid; itaconic acid; maleic acid, monoalkyl itaconate such as monomethyl itaconate and monoethyl itaconate; monoalkyl maleate such as monomethyl maleate and monoethyl maleate; citraconic acid; styrenesulfonic acid; vinylbenzylsulfonic acid; vinylsulfonic acid; acryloyloxyalkylsulfonic acid such as acryloyloxymethylsulfonic acid, acryloyloxyethylsulfonic acid and acryloyloxypropylsulfonic acid; acrylamidoalkylsulfonic acid such as 2-acrylamido-2-methylethanesulfonic acid, 2-acrylamido-2-methylbutanesulfonic acid; and methacrylamidoalkylsulfonic acid such as 2-methaacrylamido-2-methylethanesulfonic acid, 2-methacrylamido-2-methylpropanesulfonic acid and 2-methacrylamido-2-methylbutanesulfonic acid. These acids may be their salts of alkaline metals (e.g., Na, K) or ammonium ion.

In the formula, x, y and z represent the percentage by weight of each component, i.e., x is from 0.5 to 40, preferably 0.5 to 30, more preferably 1 to 20; y is from 60 to 99.5, preferably 70 to 99.5, more preferably 75 to 99; and z is from 0 to 50, preferably 0 to 35, more preferably 0 to 25.

The above-described monomer containing an anionic functional group can be optionally used irrespective of the glass transition temperature of its homopolymer. It is preferably used in an amount of 0.5 to 20% by weight, and more preferably 1 to 10% by weight, based on the total weight of a polymer.

Preferred examples of polymeric latexes represented by formula (3) are shown below, in which values in parentheses indicate the percentage by weight of each polymeric component in the copolymer.

P-1 Ethyl acrylate/M-1/acrylic acid copolymer (85/10/5)

P-2 n-Butyl acrylate/M-1/sodium 2-acrylamido-2-methylpropanesulfonate copolymer (85/10/5)

P-3 n-Butyl acrylate/M-1/methacrylic acid copolymer (85/5/10)

P-4 2-Ethylhexyl acrylate/M-2/sodium 2-acrylamido-2-methyl-propanesulfonate (75/20/5)

P-5 to p-9 n-Butyl acrylate/M-1/acrylic acid copolymer (x/y/z)

P-5 x/y/z=95/2/3

P-6 x/y/z=92/5/3

P-7 x/y/z=89/8/3

P-8 x/y/z=81/16/3

P-9 x/y/z=72/25/3

P-10 n-Butyl acrylate/styrene/M-1/methacrylic acid copolymer (65/20/5/10)

P-11 Methyl acrylate/M-4/methacrylic acid copolymer (80/15/5)

P-12 n-Butyl acrylate/M-5/acrylic acid copolymer (85/10/5)

P-13 n-Butyl acrylate/M-7/acrylic acid copolymer (85/10/5)

P-14 2-Ethylhexyl acrylate/M-9 copolymer (75/25)

P-15 n-Butyl acrylate/M-13/sodium styrenesulfonate copolymer (85/10/5)

P-16 n-Butyl acrylate/styrene/ potassium styrenesulfinate (75/29/5)

P-17 n-Hexyl acrylate/methoxyethyl acrylate/M-2 copolymer (70/20/10)

P-18 2-Ethylhexyl acrylate/M-15/methacrylic acid copolymer (90/5/5)

P-19 n-Butyl acrylate/M-1/M-17/acrylic acid copolymer (75/5/15/5)

P-20 Octyl methacrylate/M-20/sodium styrenesulfonate copolymer (80/15/5)

The polymer containing an active methylene group used in the invention (hereinafter, also denoted as the active methylene group containing polymer) is preferably prepared through emulsion polymerization. The dispersion particle size is not specifically limited, but preferably within the range of 0.01 to 1.0 $\mu$m. In the emulsion polymerization used in the invention, an aqueous soluble polymer is preferably used as an emulsifying agent. In addition thereto, a monomer is emulsified in a mixed solvent of water and a water-miscible organic solvent (e.g., methanol, ethanol, acetone, etc.) and using a radical polymerization initiator, polymerization is conducted generally at a temperature of 30 to 100° C., and preferably 40 to 90° C. The proportion of the water-miscible solvent is 0 to 100%, and preferably 0 to 50% by weight, based on water.

Polymerization reaction is carried out using a radical polymerization initiator of 0.05 to 5% by weight and optionally an emulsifying agent of 0.1 to 10% by weight. Examples of the radical polymerization initiator include azobis compounds, peroxides, hydroperoxides and redox solvents, such as potassium persulfate, ammonium persulfate, t-butyl peroctanoate, benzoyl peroxide, isopropyl carbonate, 2,4-dichlorobenzyl peroxide, methyl ethyl ketone peroxide, cumene hydroperoxide, dicumyl peroxide, 2,2'-azobis isobutylate, 2,2'-azobis(2-amidinopropane)hydrochloride, and a combination of potassium sulfite and sodium hydrogen sulfite.

Anionic, cationic, amphoteric or nonionic surfactants may be used as an emulsifying agent at the time when using the aqueous-soluble polymer. The surfactant may be used in an amount of 0 to 100%, preferably 0 to 25%, and more preferably 0 to 10% by weight, based on the aqueous soluble polymer. Preferred examples of the surfactant include sodium laurate, sodium dodecylsulfate, sodium 1-octoxycarbonylmethyl-1-octoxycarbonylmethanesulfonate, sodium dodecynaphthalenesulfonate, sodium dodecylbenzenesulfonate, sodium dodecylphosphate, cetyltrimethylammonium chloride, dodecytrimethyleneammonium chloride, N-2-ethylhexylpyridinium chloride, polyoxyethylene nonylphenyl ether, polyoxyethylene sorbitan lauric acid ester, polyvinyl alcohol, emulsifying agents and water soluble polymers described in JP-B 53-6190.

In emulsion polymerization, polymerization initiators concentrations, the polymerizing temperature and reaction time can optionally be varied. Emulsion polymerization can be carried out in such a way that monomer(s), a surfactant and medium all are added into a reaction vessel and then an initiator is introduced thereto, or polymerization can be conducted, while dropwise adding a part or all of each component. The kind and synthesis of the monomer containing an active methylene group represented by D of formula (3) and polymeric latexes can further be referred to U.S. Pat. Nos. 3,459,790, 3,619,195, 3,929,482 and 3,700,456; West German Patent 2,442,165; European Patent 13,147; JP-A 50-73625 and 50-146331.

To a silver halide photographic material used in the invention, a polymeric latex having a core/shell structure may be incorporated, in which the latex derived from ethylenically unsaturated monomers represented by formula (3) is employed as a shell, as described in JP-A 8-220669 and 8-240874.

The polymeric latex derived from ethylenically unsaturated monomers having an active methylene group may be incorporated into any one of hydrophilic colloidal layers such as a silver halide emulsion layer, an interlayer and a backing layer, preferable a silver halide emulsion layer. The amount thereof is not specifically limited, but preferably 0.03 to 2.0 g/m$^2$. and more preferably 0.1 to 1.0 g/m$^2$. The polymeric latex derived from ethylenically unsaturated monomers having an active methylene group is preferably employed in combination with gelatin. The proportion of the latex is preferably 0.5 to 50%, and more preferably 1 to 30% by weight, based on gelatin.

Developing agents used in the invention will be described below. Developing agents used for developing photographic materials according to the invention are preferably reductones represented by formula (6) as shown below; however, the following developing agents may also be employed. Thus, examples of developing agents other than the reductones include dihydroxybenzenes (e.g., hydroquinone, chlorohydroquinone, bromohydroquinone, dichlorohydroquinone, isopropylhydroquinone, methylhydoquinone, 2,3-dichlorohydroquinone, methoxyhydoquinone, 2,5-dimethylhydoquinone, potassium hydroquinone-monosulfonate, sodium hydroquinone-monosulfonate); pyrogallols; 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl -4-ethyl-3-pyrazolidone, 1-phenyl-5-methyl-3-pyrazolidone, 1-phenyl-4-methyl-4-hydroxymethyl-3-pyrazolidone, 1-phenyl-4,4-dihydroxymethyl-3-pyrazolidone, 1-p-tolyl-3-pyrazolidone, 1-phenyl-2-acetyl-4,4-dimethyl-3-pyrazolidone, 1-(2-benzothiazole)-3-pyrazolidone, 3-acetoxy-1-phenyl-3-pyrazolidone); aminophenols (e.g., o-aminophenol, p-aminophenol, N-methyl-o-aminophenol, methyl-p-aminophenol, 2,4 diaminophenol); 1-aryl-3-aminopyrazolidones (e.g., 1-(p-hydroxyphenyl)-3-amino-pyrazolidone, 1-(p-methylaminophenyl)-3-aminopyrazolidone); pyrazolones (e.g., 4-aminopyrazolone); and a mixture thereof.

Compounds represented by the following formula (6) are described below:

formula (6)

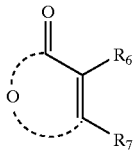

wherein $R_6$ and $R_7$ each represent independently hydroxy, OM (in which M represents an alkali metal atom or ammonium group); amino group, which may be substituted by a substituent, preferably having 1 to 10 carbon atoms, e.g., methyl, ethyl, n-butyl, hydroxyethyl, etc.; acylamino group (e.g., acetylamino, benzoylamino); alkylsulfonylamino group (e.g., methanesulfonylamino, etc.); arylsulfonylamino group (e.g., benzoylsulfonylamino, p-toluenesulfonylamino, etc.); alkoxycarbonylamino (e.g., methoxycarbonylamino, etc.); mercapto; alkylthio group (e.g., methylthio, ethylthio, etc.); Of these, $R_6$ and $R_7$ each are preferably a hydroxy group, an amino group, alkylaminosulfonyl group or arylsulfonylamino group. Q is an atomic group necessary for forming 5- or 6-membered ring. Preferably, the ring is comprised of a carbon atom, oxygen atom or nitrogen atom, and two vinyl carbon atoms which are substituted by $R_6$ and $R_7$ and a carbonyl carbon atom are combined with each other to form a 5- or 6-membered ring. As constituting examples of Q, the ring is constituted by a combination of —O—, —$CR_2(R_3)$—, —$C(R_4)$=, —C(=O)—, —$N(R_5)$—, and —N=, in which $R_2$, $R_3$, $R_4$ and $R_5$ each represent a hydrogen atom, hydroxy group, carboxy group or an alkyl group having 1 to 10 carbon atoms which my be substituted by a substituent such as a hydroxy group, carboxy group or sulfoxy group. The 5- or 6-membered ring may be condensed to form saturated or unsaturated ring. Examples of the 5- or 6-membered ring includes a dihydroxyfuranone ring, dihydroxypyrrone ring, pyranone ring, cyclopentenone ring, pyrolinone ring, pyrazolinone ring, pyridone ring, azacyclohexenone ring and uracil. Of these, the dihydroxyfuranone ring, cyclopentenone ring, cyclohexenone ring, pyrazolinone ring, azacyclohexenone ring and uracil ring are preferred.

Exemplary examples of the compounds represented by formula (6) are shown as below, but is by no means limited to these.

6-1

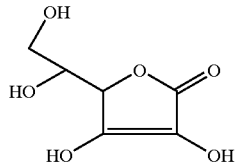

6-2

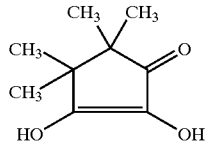

6-3

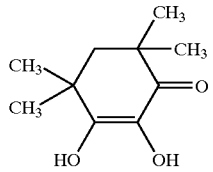

6-4

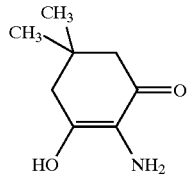

6-5

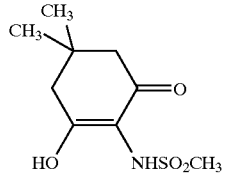

6-6

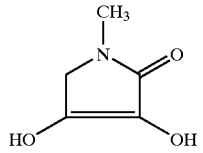

6-7

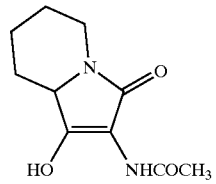

6-8

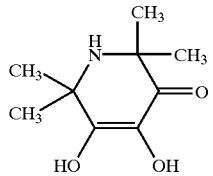

6-9

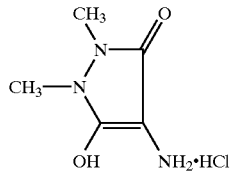

-continued 6-10

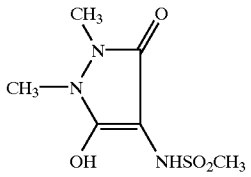

6-11

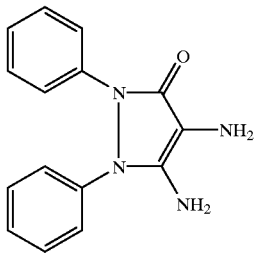

6-12

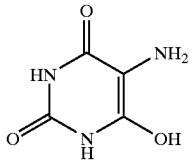

6-13

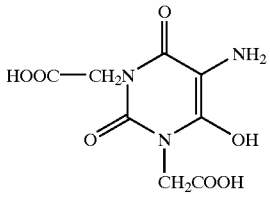

6-14

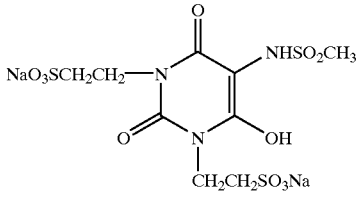

6-15

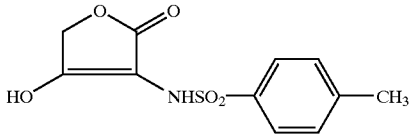

6-16

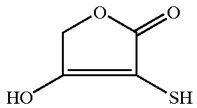

6-17

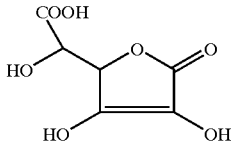

-continued 6-18

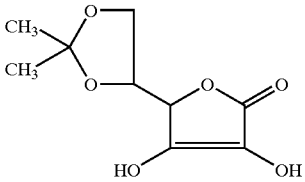

6-19

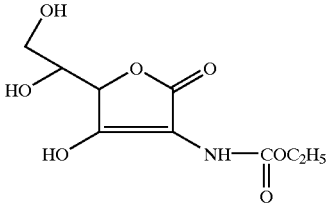

6-20

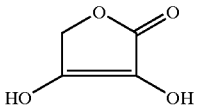

6-21

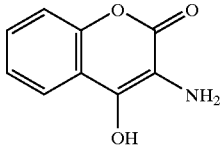

6-22

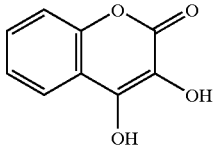

6-23

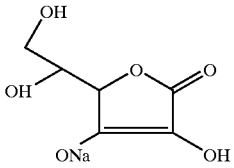

Of the above examples, ascorbic acid or its stereo-isomer, erythorbic acid is preferred (6-1).

Developers used in the invention will be described. A developer solution used in the invention does not contain any aldehyde type hardener. The developer solution contain contains an alkaline agent. Alkaline agents may be any one which is capable of making the pH of the developer solution 8.0 or more when dissolved in the developer solution. Preferred examples thereof include sodium hydroxide, potassium hydroxide, lithium hydroxide and compounds with buffering capability such as sodium carbonate, potassium carbonate, sodium hydrogencarbonate, trisodium phosphate, tripotassium phosphate, sodium salicylate and potassium salicylate.

Further, solubilizing aid (e.g., polyethylene glycols and esters thereof), pH adjusting agent (e.g., organic acid such as citric acid), sensitizer (e.g., quaternary ammonium salt), development-accelerating agent, hardening agent (e.g., dialdehydes such as glutar aldehyde), surfactant, azole type organic antifoggant (e.g., indazoles, imidazoles, benzimidazoles, tetrazoles, thiadiazoles), and sequestering agent for sequestering calcium ions contained in tap water used for a processing solution (e.g., sodium hexametaphosphate, calcium hexametaphosphate, polyphosphates) are usable. These may be contained in the solid processing composition or added to the processing solution in which the solid processing composition is dissolved. Furthermore, an anti-silver staining agent may be usable, as described in JP-A 56-24347.

The developer solution usable in the invention has a pH of 8.0 or more, preferably, 9.0 to 12.5. The developing solution may contain an amino-compound such as alkanolamines described in JP-A 56-106244. The developing solution may further contain compounds described in F. A. Mason, "Photographic Processing Chemistry", Focal press (1966), pages 22–229; U.S. Pat. Nos. 2.193,015 and 2,592, 364; and JP-A 48-64933.

Fixer solutions used in the invention will be described below. Furthermore, the fixer solution used in the invention does not contain boric acid. A fixing agent is preferably thiosulfates. Thiosulfates are employed in the form of a lithium, potassium, sodium or ammonium salt. Ammonium thiosulfate or sodium thiosulfate is preferred in terms of the fixing speed. Furthermore, iodide salts or thiocyanates are also employed as a fixing agent. The fixer solution used in the invention mat contains sulfites in the form of lithium, sodium, potassium or ammonium salt.

The fixer solution may contain a water soluble chromium salt or aluminum salt. Examples of the water soluble chromium salt or aluminum salt include chromium alum, aluminum sulfate, potassium aluminum chloride, aluminum chloride.

The fixer solution may contain an acetate ion. The acetate ion is optionally usable and acetic acid and a lithium, potassium, sodium or ammonium acetate are preferably used. Of these, sodium or ammonium acetate is particularly preferred.

Furthermore, gluconic acid, citric acid, tartaric acid, malic acid, succinic acid, phenylacetic acid, lactic acid or salts thereof may be contained. There is also usable a lithium, potassium, sodium or ammonium salt, such as potassium gluconate, sodium gluconate, potassium citrate, lithium citrate, sodium citrate, ammonium citrate, lithium tartarate, potassium tartarate, sodium hydrogentartarate, sodium tartarate, ammonium tartarate, ammonium hydrogentartarate, ammonium potassium tartarate, sodium potassium tartarate, sodium malate, ammonium malate, sodium succinate and ammonium succinate. Of these compounds are preferred gluconic acid, citric acid, isocitric acid, malic acid, lactic acid and salts thereof. As other acids, inorganic acids such as sulfuric acid, hydrochloric acid, nitric acid, and organic acids such as formic acid, propionic acid, oxalic acid and malic acid are each usable.

Aminopolycarboxylic acid such as nitrilotriacetic acid and ethylenediaminetetraacetic acid and salt thereof are used as a chelating agent. An anionic surfactant such as sulfuric esters and sulfonates, polyethylene glycol-type or ester-type nonionic surfactant, and amphoteric surfactant are used as a surfactant. As a lubricant is cited an alkanolamine or an alkylene glycol. As a fixing accelerator are cited thiourea derivatives, an alcohol having a triple bond and thioethers. The pH of the fixer solution used in the invention is 3.8 or more and preferably 4.2 to 5.5. The replenishing rate of alkaline developer solution and fixer solution is preferably 20 ml or less, more preferably 15 ml or less per sheet of 10×12 inch size.

In the invention, processing composition in a solid form are preferably employed. The solid processing composition is dissolved to be used as a processing solution. The processing composition is preferably employed in the form of granules or a tablet.

Next, solidification of the processing composition will be described. The processing composition can be solidified in such a manner that the processing composition in the form of a concentrated solution, fine powder or granules is mixed with a water soluble bonding agent and then the mixture is molded, or the water soluble bonding agent is sprayed on the surface of temporarily-molded processing composition to form a covering layer, as described in JP-A 4-29136, 4-85533, 4-85534, 4-85535, 4-85536 and 4-172341.

A preferred tablet-making process is to form a tablet by compression-molding after granulating powdery processing composition. As compared to a solid composition prepared simply by mixing the processing composition to form a table, there is an advantage that improvements in solubility and storage stability were achieved and resultingly, the photographic performance becomes stable.

As for granulation process which is carried out prior to tablet-making process, any conventionally known method such as fluidized-bed granulation process, extrusion granulation process, compression granulation process, crush granulation process, fluid layer granulation process, and spray-dry granulation process can be employed. It is preferred that the average grain size of the granules is 100 to 800 $\mu$m and preferably 200 to 750 $\mu$m. In particular, 60% or more of the granules is with a deviation of ±100 to 150 $\mu$m. When the grain size smaller, it tends to cause localization of mixing elements and therefore, is undesirable. As hydraulic press machine, any conventional compression molding machine, such as a single-engined compression molding machine, rotary-type compression machine, briquetting machine, etc. may be employed to form a tablet. Compression-molded (compression-tableted) solid processing composition may take any form and is preferably in a cylindrical form from the point of productivity, handleability and problems of powder dust in cases when used in user-side. It is further preferred to granulate separately each component, such as an alkali agent, reducing agent and preservative in the above process.

The processing composition in the form of a tablet can be prepared according to methods, as described in JP-A 51-61837, 54-155038, 52-88025, and British Patent 1,213, 808. The granular processing composition can also be prepared according to methods. as described in JP-A 2-109042, 2-109043, 3-39735 and 3-39739. The powdery processing composition can be prepared according to methods, as described in JP-A 54-133332, British Patent 725,892 and 729,862 and German Patent 3,733,861.

EXAMPLES

Embodiments of the invention will be further described based on examples, but the present invention is not limited to these examples.

Example 1

Emulsions described below were each prepared using a reaction vessel of 32 lit. in volume. There were also employed ultrafiltration unit SIP-1013 (available from Asahi Chemical Industry Co., Ltd.) and circulation pump DAIDO Rotary Pump. The volume of the emulsion circulation portion in the ultrafiltration process was 1.2 lit. and each emulsion was allowed to circulate at a rate of 15 lit./min. The residence time of a reaction mixture solution was 4.8 sec. and the volume of the emulsion circulation portion in the ultrafiltration process was 3.8% of the reaction vessel. The intergrain distance during grain growth was controlled through controlling the permeation flux in the ultrafiltration, for example, by using a flow rate-adjusting valve 19 in FIG. 1.

Preparation of Emulsion Em-1-1

Nucleation

An aqueous gelatin solution B-101 in a reaction vessel was maintained at 30° C. and was adjusted to a pH of 1.96 with a 1N sulfuric acid aqueous solution, while stirring at a rate of 450 revolutions per min. by a mixing stirrer described in JP-B 62-160128. Then, solutions S-101 and X-101 were added by the double jet method at a flow rate of 5.0 ml/sec. to form nucleus grains.

| B-101 | |
|---|---|
| Low molecular weight type gelatin (average molecular weight 20,000) | 32.4 g |
| Potassium bromide | 9.92 g |
| Water | 12938.0 ml |
| S-101 | |
| Silver nitrate | 50.43 g |
| Water | 225.9 ml |
| X-101 | |
| Potassium bromide | 35.33 g |
| Water | 224.7 ml |

Ripening

After completing addition was further added thereto solution G-101 as shown below, the temperature was raised to 60° C. in 30 min. and the reaction mixture solution was held at 60° C. for 20 min. Then, the solution was adjusted to a pH of 9.5 with an aqueous 28% ammonia solution and further held for 7 min. then the pH was adjusted to 5.8 with 1N nitric acid aqueous solution, while the silver potential, which was measured with a silver ion selection electrode using a saturated silver/silver chloride reference electrode, was maintained at 14 mV with a 1N potassium bromide solution.

| G-101 | |
|---|---|
| Alkali-treated inert gelatin (average molecular weight 100,000) | 139.1 g |
| Compound A (10 wt. % methanol solution) | 4.64 ml |
| Water | 3266.0 ml |
| Compound A: $HO(CH_2CH_2O)m[CH(CH_3)CH_2O]_{19.8}(CH_2CH_2O)nH$ (m + n = 9.77) | |

Grain Growth-1

After completion of ripening, solutions S-102 and X-102 were added by the double jet method at an accelerated flow rate (12 times faster at the end than at the start) over a period of 38 min. After completing addition, solution G-102 was added thereto, and after adjusting the stirring rate to 550 revolutions per min., solutions S-103 and X-103 were added at an accelerated flow rate (2 times faster at the end than at the start) over a period of 40 min., while the silver potential was maintained 14 mV using 1N potassium bromide solution.

| S-102 | |
|---|---|
| Silver nitrate | 639.8 g |
| Water | 2866.2 ml |
| X-102 | |
| Potassium bromide | 448.3 g |
| Water | 2850.7 ml |
| G-102 | |
| Alkali-treated inert gelatin (average molecular weight 100,000) | 203.4 g |
| Compound A (10 wt. % methanol solution) | 6.20 ml |
| Water | 1867.0 ml |
| S-103 | |
| Silver nitrate | 989.8 g |
| Water | 1437.2 ml |
| X-103 | |
| Potassium bromide | 679.6 g |
| Potassium iodide | 19.35 g |
| Water | 1412.0 ml |

Grain Growth-2

After completing addition, the reaction mixture solution in the reaction vessel was lowered to a temperature of 40° C. in 20 min. and after adjusting the silver potential to −32 mV with 3.5N potassium bromide solution, solutions S-104 and X-104 were added by the double jet method at an accelerated flow rate (1.2 times faster at the end than at the start) over a period of 7 min.

| S-104 | |
|---|---|
| Silver nitrate | 672.0 g |
| Water | 975.8 ml |
| X-104 | |
| Potassium bromide | 470.8 g |
| Water | 959.4 ml |

In the emulsion preparation process described above, the maximum volume of the reaction mixture solution in the reaction vessel was 28.9 lit. Therefore, it was possible to prepare an emulsion corresponding to a maximum of 0.49 (mol/l)×32 lit.

After completing the grain growth, the emulsion was desalted according to the conventional flocculation process and after redispersing with adding gelatin, the pH and pAg were adjusted to 5.8 and 8.1, respectively, at 40° C. to obtain emulsion Em-1-1.

Fine grain emulsions used in the emulsion making was prepared as follows.

Preparation of Fine Silver Iodide Grain Emulsion a 2000 ml Solution containing 35 g gelatin was maintained at 40° C. with stirring. After adjusting the silver potential to −150 mV versus a saturated calomel electrode using KI aqueous solution, silver nitrate (178 g) solution and potassium iodide (174 g) solution were added by the double jet method at an accelerated flow rate over a period of 13 min. After desalting, gelatin was added thereto and the pH and pAg were adjusted to 6.8 and 9 at 50° C. and cooled to be set, respectively. The obtained fine silver iodide grain emulsion a was comprised of fine silver iodide grains having a mean equivalent circular diameter of 0.05 μm.

Preparation of Metal-containing, Fine Silver Iodide Grain Emulsion b

Metal-containing, fine silver iodide grain Emulsion b was prepared in a manner similar to fine silver iodide grain Emulsion a, provided that the potassium iodide solution which was added with the silver nitrate solution, further contained 0.45 g of a potassium salt of SET-2.

Preparation of Fine Silver Bromide Grain Emulsion c

To 2.6 lit. of 2.0 wt % gelatin solution containing 0.026 mol potassium bromide with stirring, 1.2 mol silver nitrate solution and 1.1 mol potassium bromide solution, each 2000 ml were added by the double jet method over a period of 15 min., while the gelatin solution was maintained at 30° C. After completing addition, the emulsion was washed according to the conventional flocculation process. Gelatin of 30 g was added thereto and then the pH and pAg were adjusted to 6.5 and 8.1 and cooled to be set, respectively. The resulting emulsion was comprised of fine silver bromide grains having a mean grain size (equivalent circular diameter) of 0.05 $\mu$m.

Preparation of Metal-containing Fine Silver Bromide Grain Emulsion d

Metal-containing, fine silver iodide grain Emulsion d was prepared in a manner similar to fine silver bromide grain Emulsion a, provided that the potassium bromide solution which was added with the silver nitrate solution, further contained 0.52 g of a potassium salt of SET-2.

Preparation of Emulsion Em-1-2

Emulsion Em-1-2 was prepared in a manner similar to Emulsion Em-1-1, provided that after raising the temperature to 60° C., 100 ml of a solution containing 0.18 g of potassium salt of SET-2, $K_4[Ru(CN)_6].3H_2O$.

Preparation of Emulsion Em-1-3

Emulsion Em-1-3 was prepared in a manner similar to Emulsion Em-1-1, provided that after raising the temperature to 60° C., fine silver iodide grain Emulsion b was added in an amount equivalent to 0.18 g doping amount of potassium salt of SET-2, $K_4[Ru(CN)_6].3H_2O$.

Preparation of Emulsion Em-1-4

Emulsion Em-1-4 was prepared in a manner similar to Emulsion Em-1-1, provided that after raising the temperature to 60° C., fine silver bromide grain Emulsion d was added in an amount equivalent to 0.18 g doping amount of potassium salt of SET-2, $K_4[Ru(CN)_6].3H_2O$.

Preparation of Emulsion Em-1-5

Emulsion Em-1-5 was prepared in a manner similar to Emulsion Em-1-1, provided that after adding 28% aqueous ammonia solution, 100 ml of a solution containing 0.18 g of potassium salt of SET-2, $K_4[Ru(CN)_6].3H_2O$.

Preparation of Emulsion Em-1-6

Emulsion Em-1-6 was prepared in a manner similar to Emulsion Em-1-1, provided that after adding 28% aqueous ammonia solution, fine silver iodide grain Emulsion b was added in an amount equivalent to 0.18 g doping amount of potassium salt of SET-2, $K_4[Ru(CN)_6].3H_2O$.

Preparation of Emulsion Em-1-7

Emulsion Em-1-7 was prepared in a manner similar to Emulsion Em-1-1, provided that after adding 28% aqueous ammonia solution, fine silver bromide grain Emulsion d was added in an amount equivalent to 0.18 g doping amount of potassium salt of SET-2, $K_4[Ru(CN)_6].3H_2O$.

Preparation of Emulsion Em-1-8

Emulsion Em-1-8 was prepared in a manner similar to Emulsion Em-1-1, provided that after the temperature was allowed to be lowered to 40° C., the silver potential in the grain growth-2 was adjusted to −32 mV and 100 ml of a solution containing 0.18 g of potassium salt of SET-2, $K_4[Ru(CN)_6].3H_2O$.

Preparation of Emulsion Em-1-9

Emulsion Em-1-9 was prepared in a manner similar to Emulsion Em-1-1, provided that after the temperature was allowed to be lowered to 40° C., the silver potential in the grain growth-2 was adjusted to −32 mV and fine silver iodide grain Emulsion b was added in an amount equivalent to 0.18 g doping amount of potassium salt of SET-2, $K_4[Ru(CN)_6].3H_2O$.

Preparation of Emulsion Em-1-10

Emulsion Em-1-10 was prepared in a manner similar to Emulsion Em-1-1, provided that after the temperature was allowed to be lowered to 40° C., the silver potential in the grain growth-2 was adjusted to −32 mV and fine silver bromide grain Emulsion d was added in an amount equivalent to 0.18 g doping amount of potassium salt of SET-2, $K_4[Ru(CN)_6].3H_2O$.

Grains of each of the thus obtained emulsions, Em-1-1 to Em-1-10 were observed with respect to dislocation lines and it was proved that 5 to 10 dislocation lines were observed in the grain fringe portions of Em-1-3, Em-1-6 and Em-1-9.

Preparation of Emulsion Em-2-1

Using a silver halide emulsion preparation apparatus having the same constitution as shown in FIG. 1, a silver halide emulsion was prepared in accordance with the following procedure.

Nucleation

An aqueous gelatin solution B-201 in a reaction vessel was maintained at 30° C. and was adjusted to a pH of 1.96 with a 1N sulfuric acid aqueous solution, while stirring at a rate of 450 revolutions per min. by a mixing stirrer described in JP-B 62-160128. Then, solutions S-201 and X-201 were added by the double jet method at a flow rate of 5.0 ml/sec. to form nucleus grains.

| | |
|---|---|
| B-201 | |
| Low molecular weight type gelatin (average molecular weight 20,000) | 32.4 g |
| Potassium bromide | 9.92 g |
| Water | 12938.0 ml |
| S-201 | |
| Silver nitrate | 50.43 g |
| Water | 225.9 ml |
| X-201 | |
| Potassium bromide | 35.33 g |
| Water | 224.7 ml |

Ripening

After completing addition was further added thereto solution G-201 as shown below, the temperature was raised to 60° C. in 30 min. and the reaction mixture solution was held at 60° C. for 20 min. Then, the solution was adjusted to a pH of 9.5 with an aqueous 28% ammonia solution and further held for 7 min. and then, the pH was adjusted to 5.4 with a 1N nitric acid aqueous solution, while the silver potential which was measured with a silver ion selection electrode using a saturated silver/silver chloride reference electrode, was maintained at 4 mV with a 1N potassium bromide solution.

| G-201 | |
|---|---|
| Alkali-treated inert gelatin (average molecular weight 100,000) | 139.1 g |
| Compound A (10 wt. % methanol solution) | 4.64 ml |
| Water | 3266.0 ml |

Grain Growth-1

After completion of ripening, solutions S-202 and X-202 were added by the double jet method at an accelerated flow rate (12 times faster at the end than at the start) over a period of 38 min, while the silver potential was maintained at 6 mV with 1N potassium bromide solution. After completing addition, solution G-202 was added thereto, and after adjusting the stirring rate to 550 revolutions per min., solutions S-203 and X-203 were added at an accelerated flow rate (2 times faster at the end than at the start) over a period of 40 min., while the silver potential was continuously varied from 4 mV to −2 mV using 1N potassium bromide solution. Concurrently with adding solutions S-202 and X-202, the reaction mixture solution in the reaction vessel was circulated through an ultrafiltration unit to concentrate the reaction mixture volume by ultrafiltration so that the mean intergrain distance during the overall period of grain growth-1 was kept the same as that at the start of grain growth-1.

| S-202 | |
|---|---|
| Silver nitrate | 639.8 g |
| Water | 2866.2 ml |
| X-202 | |
| Potassium bromide | 448.3 g |
| Water | 2850.7 ml |
| G-202 | |
| Alkali-treated inert gelatin (average molecular weight 100,000) | 203.4 g |
| Compound A (10 wt. % methanol solution) | 6.20 ml |
| Water | 1867.0 ml |
| S-203 | |
| Silver nitrate | 989.8 g |
| Water | 1437.2 ml |
| X-203 | |
| Potassium bromide | 679.6 g |
| Potassium iodide | 19.35 g |
| Water | 1412.0 ml |

Grain Growth-2

After completing addition, the reaction mixture solution in the reaction vessel was lowered to a temperature of 40° C. in 20 min. and after adjusting the silver potential to −52 mV with 3.5N potassium bromide solution, solutions S-204 and X-204 were added by the double jet method at an accelerated flow rate (1.2 times faster at the end than at the start) over a period of 7 min. From completion of concentration in the grain growth-1 to completion of the grain growth-2, circulation of the reaction mixture through the ultrafiltration unit continued.

| S-204 | |
|---|---|
| Silver nitrate | 672.0 g |
| Water | 975.8 ml |
| X-204 | |
| Potassium bromide | 470.8 g |
| Water | 959.4 ml |

In the emulsion preparation process described above, the maximum volume of the reaction mixture solution in the reaction vessel was 20.3 lit. Therefore, it was possible to prepare an emulsion corresponding to a maximum of 0.70 (mol/l)×32 lit.

After completing the grain growth, the emulsion was desalted according to conventional method and after redispersing with adding gelatin, the pH and pAg were adjusted to 5.8 and 8.1, respectively, at 40° C. to obtain emulsion Em-2-1.

Preparation of Emulsion Em-2-2

Emulsion Em-2-2 was prepared in a manner similar to Emulsion Em-2-1, provided that after raising the temperature to 60° C., 100 ml of a solution containing 0.18 g of potassium salt of SET-2, $K_4[Ru(CN)_6].3H_2O$.

Preparation of Emulsion Em-2-3

Emulsion Em-2-3 was prepared in a manner similar to Emulsion Em-2-1, provided that after raising the temperature to 60° C., fine silver iodide grain Emulsion b was added in an amount equivalent to 0.18 g doping amount of potassium salt of SET-2, $K_4[Ru(CN)_6].3H_2O$.

Preparation of Emulsion Em-2-4

Emulsion Em-2-4 was prepared in a manner similar to Emulsion Em-2-1, provided that after raising the temperature to 60° C., fine silver bromide grain Emulsion d was added in an amount equivalent to 0.18 g doping amount of potassium salt of SET-2, $K_4[Ru(CN)_6].3H_2O$.

Preparation of Emulsion Em-2-5

Emulsion Em-2-5 was prepared in a manner similar to Emulsion Em-2-1, provided that after adding 28% aqueous ammonia solution, 100 ml of a solution containing 0.18 g of potassium salt of SET-2, $K_4[Ru(CN)_6].3H_2O$.

Preparation of Emulsion Em-2-6

Emulsion Em-2-6 was prepared in a manner similar to Emulsion Em-2-1, provided that after adding 28% aqueous ammonia solution, fine silver iodide grain Emulsion b was added in an amount equivalent to 0.18 g doping amount of potassium salt of SET-2, $K_4[Ru(CN)_6].3H_2O$.

Preparation of Emulsion Em-2-7

Emulsion Em-2-7 was prepared in a manner similar to Emulsion Em-2-1, provided that after adding 28% aqueous ammonia solution, fine silver bromide grain Emulsion d was added in an amount equivalent to 0.18 g doping amount of potassium salt of SET-2, $K_4[Ru(CN)_6].3H_2O$.

Preparation of Emulsion Em-2-8

Emulsion Em-2-8 was prepared in a manner similar to Emulsion Em-2-1, provided that after the temperature was allowed to be lowered to 40° C., the silver potential in the grain growth-2 was adjusted to −52 mV and 100 ml of a solution containing 0.18 g of potassium salt of SET-2, $K_4[Ru(CN)_6].3H_2O$.

Preparation of Emulsion Em-2-9

Emulsion Em-2-9 was prepared in a manner similar to Emulsion Em-2-1, provided that after the temperature was allowed to be lowered to 40° C., the silver potential in the grain growth-2 was adjusted to −52 mV and fine silver iodide grain Emulsion b was added in an amount equivalent to 0.18 g doping amount of potassium salt of SET-2, $K_4[Ru(CN)_6].3H_2O$.

Preparation of Emulsion Em-2-10

Emulsion Em-2-10 was prepared in a manner similar to Emulsion Em-2-1, provided that after the temperature was allowed to be lowered to 40° C., the silver potential in the grain growth-2 was adjusted to −52 mV and fine silver bromide grain Emulsion d was added in an amount equivalent to 0.18 g doping amount of potassium salt of SET-2, $K_4[Ru(CN)_6].3H_2O$.

Grains of each of the thus obtained emulsions, Em-2-1 to Em-2-10 were observed with respect to dislocation lines and it was proved that 15 to 20 dislocation lines were observed in the grain fringe portions of Em-2-3, Em-2-6 and Em-2-9.

Preparation of Emulsion Em-3-1

Emulsion Em-3-1 was prepared in a manner similar to Emulsion Em-2-1, except for the process described below.

Grain Growth-1

Thus, after completion of ripening, solutions S-202 and X-2-2 were added by the double jet method at an accelerated flow rate (12 times faster at the end than at the start) over a period of 38 min, while the silver potential was maintained at 6 mV with 1N potassium bromide solution. After completing addition, solution G-202 was added thereto, and after adjusting the stirring rate to 550 revolutions per min., solutions S-203 and X-203 were added at an accelerated flow rate (2 times faster at the end than at the start) over a period of 40 min., while the silver potential was continuously varied from 4 mV to −2 mV using 1N potassium bromide solution. Concurrently with adding solutions S-2-2 and X-202, the reaction mixture solution in the reaction vessel was circulated through an ultrafiltration unit to concentrate the reaction mixture volume by ultrafiltration so that the mean intergrain distance during the overall stage of grain growth-1 was kept at the mean intergrain distance at the start of grain growth-1.

Grain Growth-2

After completing addition, the reaction mixture solution in the reaction vessel was lowered to a temperature of 40° C. in 20 min. and after adjusting the silver potential to −32 mV with 3.5N potassium bromide solution, solutions S-204 and X-204 were added by the double jet method at an accelerated flow rate (1.2 times faster at the end than at the start) over a period of 7 min. Concentration was continuously run from the grain growth-1, and the intergrain distance was controlled to be linearly decrease so that the mean intergrain distance at the end of the grain growth-2 was 0.7 times that of the start.

In the emulsion making process described above, the maximum volume of the reaction mixture solution in the reaction vessel was 17.1 lit. Therefore, it was possible to prepare an emulsion corresponding to a maximum of 0.83 (mol/l)×32 lit.

Preparation of Emulsion Em-3-2

Emulsion Em-3-2 was prepared in a manner similar to Emulsion Em-3-1, provided that after adding 28% aqueous ammonia solution, 100 ml of a solution containing 0.18 g of potassium salt of SET-2, $K_4[Ru(CN)_6].3H_2O$.

Preparation of Emulsion Em-3-3

Emulsion Em-3-3 was prepared in a manner similar to Emulsion Em-3-1, provided that after adding 28% aqueous ammonia solution, fine silver iodide grain Emulsion b was added in an amount equivalent to 0.18 g doping amount of potassium salt of SET-2, $K_4[Ru(CN)_6].3H_2O$.

Preparation of Emulsion Em-3-4

Emulsion Em-3-4 was prepared in a manner similar to Emulsion Em-3-1, provided that after adding 28% aqueous ammonia solution, fine silver bromide grain Emulsion d was added in an amount equivalent to 0.18 g doping amount of potassium salt of SET-2, $K_4[Ru(CN)_6].3H_2O$.

Preparation of Emulsion Em-3-5

Emulsion Em-3-5 was prepared in a manner similar to Emulsion Em-3-1, provided that 0.18 g of potassium salt of SET-2, $K_4[Ru(CN)_6].3H_2O$ was added to gelatin solution G-202 used in the grain growth-1.

Preparation of Emulsion Em-3-6

Emulsion Em-3-6 was prepared in a manner similar to Emulsion Em-3-1, provided that fine silver iodide grain Emulsion b was added, in an amount equivalent to 0.18 g doping amount of potassium salt of SET-2, $K_4[Ru(CN)_6].3H_2O$, to gelatin solution G-202 used in the grain growth-1.

Preparation of Emulsion Em-3-7

Emulsion Em-3-7 was prepared in a manner similar to Emulsion Em-3-1, provided that fine silver bromide grain Emulsion d was added, in an amount equivalent to 0.18 g doping amount of potassium salt of SET-2, $K_4[Ru(CN)_6].3H_2O$, to gelatin solution G-202 used in the grain growth-1.

Preparation of Emulsion Em-3-8

Emulsion Em-3-8 was prepared in a manner similar to Emulsion Em-3-1, provided that after the temperature was allowed to be lowered to 40° C., the silver potential in the grain growth-2 was adjusted to −32 mV and 100 ml of a solution containing 0.18 g of potassium salt of SET-2, $K_4[Ru(CN)_6].3H_2O$.

Preparation of Emulsion Em-3-9

Emulsion Em-3-9 was prepared in a manner similar to Emulsion Em-3-1, provided that after the temperature was allowed to be lowered to 40° C., the silver potential in the grain growth-2 was adjusted to −32 mV and fine silver iodide grain Emulsion b was added in an amount equivalent to 0.18 g doping amount of potassium salt of SET-2, $K_4[Ru(CN)_6].3H_2O$.

Preparation of Emulsion Em-3-10

Emulsion Em-3-10 was prepared in a manner similar to Emulsion Em-3-1, provided that after the temperature was allowed to be lowered to 40° C., the silver potential in the grain growth-2 was adjusted to −32 mV and fine silver bromide grain Emulsion d was added in an amount equivalent to 0.18 g doping amount of potassium salt of SET-2, $K_4[Ru(CN)_6].3H_2O$.

Grains of each of the thus obtained emulsions, Em-3-1 to Em-3-10 were observed with respect to dislocation lines and it was proved that 15 to 20 dislocation lines were observed in the grain fringe portions of Em-3-3, Em-3-6 and Em-3-9.

Preparation of Emulsion Em-4-1

Emulsion Em-4-1 was prepared in a manner similar to Emulsion Em-2-1, except for the process described below.

Grain Growth-1

After completion of ripening, solutions S-202 and X-202 were added by the double jet method at an accelerated flow rate (12 times faster at the end than at the start) over a period of 38 min. Concurrently with adding solutions S-202 and X-202, the reaction mixture solution in the reaction vessel was circulated through an ultrafiltration unit to concentrate the reaction mixture volume by ultrafiltration so that the mean intergrain distance during addition of solutions S-2-2 and X-202 was kept the same as that at the start of grain growth-1. After completing addition of solutions S-202 and X-202, the reaction mixture solution in the reaction vessel was concentrated using an ultrafiltration unit so that the mean intergrain distance was 0.5 times that of the start. Concentration was further run by circulating the reaction mixture solution through the ultrafiltration unit until completion of the grain growth so that the mean intergrain distance over the grain growth was 0.5 times that of the start.

In the process of making emulsion Em-401 described above, the maximum volume of the reaction mixture solution in the reaction vessel was 20.3 lit. Therefore, it was possible to prepare an emulsion corresponding to a maximum of 0.70 (mol/l)×32 lit.

Preparation of Emulsion Em-4-2

Emulsion Em-4-2 was prepared in a manner similar to Emulsion Em-4-1, provided that after completion of adding solutions S-202 and X-202 in the grain growth-1, 100 ml of a solution containing 0.18 g of potassium salt of SET-2, $K_4[Ru(CN)_6].3H_2O$.

Preparation of Emulsion Em-4-3

Emulsion Em-4-3 was prepared in a manner similar to Emulsion Em-4-1, provided that after completion of adding solutions S-202 and X-202 in the grain growth-1, fine silver iodide grain Emulsion b was added in an amount equivalent to 0.18 g doping amount of potassium salt of SET-2, $K_4[Ru(CN)_6].3H_2O$.

Preparation of Emulsion Em-4-4

Emulsion Em-4-4 was prepared in a manner similar to Emulsion Em-4-1, provided that after completion of adding solutions S-202 and X-202 in the grain growth-1, fine silver bromide grain Emulsion d was added in an amount equivalent to 0.18 g doping amount of potassium salt of SET-2, $K_4[Ru(CN)_6].3H_2O$.

Preparation of Emulsion Em-4-5

Emulsion Em-4-5 was prepared in a manner similar to Emulsion Em-4-1, provided that after the temperature was allowed to be lowered to 40° C., the silver potential in the grain growth-2 was adjusted to −32 mV and 100 ml of a solution containing 0.18 g of potassium salt of SET-2, $K_4[Ru(CN)_6].3H_2O$.

Preparation of Emulsion Em-4-6

Emulsion Em-4-6 was prepared in a manner similar to Emulsion Em-4-1, provided that after the temperature was allowed to be lowered to 40° C., the silver potential in the grain growth-2 was adjusted to −32 mV and fine silver iodide grain Emulsion b was added in an amount equivalent to 0.18 g doping amount of potassium salt of SET-2, $K_4[Ru(CN)_6].3H_2O$.

Preparation of Emulsion Em-4-7

Emulsion Em-4-7 was prepared in a manner similar to Emulsion Em-4-1, provided that after the temperature was allowed to be lowered to 40° C., the silver potential in the grain growth-2 was adjusted to −32 mV and fine silver bromide grain Emulsion d was added in an amount equivalent to 0.18 g doping amount of potassium salt of SET-2, $K_4[Ru(CN)_6].3H_2O$.

Grains of each of the thus obtained emulsions, Em-4-1 to Em-4-7 were observed with respect to dislocation lines and it was proved that 15 to 20 dislocation lines were observed in the grain fringe portions of Em-4-3 and Em-4-6 and. During the preparation of each emulsion, sampling of emulsion grains and electronmicroscopic observation thereof were optimally conducted, and neither formation of a new grain nor growth thereof were observed in any of the emulsions. Characteristics of each emulsion was determined using the replica method. Results thereof are shown in Table 1. It was proved that the mean intergrain distance at the start of the growth was 2.2 μm in any of the emulsions and the mean size of grains contained in each emulsion was 0.58 μm, which was represented by equivalent converted to cube.

Next, each of the emulsions was raised to be 60° C. and a given amount of a spectral sensitization dye was added thereto in the form of a solid fine-grain dispersion. After adding it, an aqueous mixed solution of adenine, ammonium thiocyanate, chloroauric acid and sodium thiosulfate and a dispersion of triphenyl phosphine selenide were added and, after 60 minutes, a silver iodide fine-grained emulsion was added. Then, a chemical-ripening treatment was carried out for two hours in total. At the time of completing the ripening treatment, a given amount of 4-hydroxy-6-methyl-1,3,3a,7-tetrazaindene (TAI) was added as a stabilizer.

The above-mentioned additives and the amount of them added (per mol of AgX) are shown below.

| | |
|---|---|
| Anhydride of sodium 5,5'-dichloro-9-ethyl-3,3'-(3-sulfopropyl)-oxacarbocyanine | 400 mg |
| An anhydride of sodium 5,5'-di-(butoxycarbonyl)-1,1'-diethyl-3,3'-di-(4-sulfobutyl)-benzoimidazolocarbo-cyanine | 4.0 mg |
| Adenine | 15 mg |
| Potassium thiocyanate | 95 mg |
| Chloroauric acid | 2.5 mg |
| Sodium thiosulfate | 2.0 mg |
| Triphenylphosphine selenide | 0.2 mg |
| Silver iodide fine grain d | 0.3 mole equivalent |
| 4-hydroxy-6-methyl-1,3,3a,7-tetrazaindene (TAI) | 500 mg |

The solid, fine-grain, dispersion of the spectral sensitization dyes were each prepared in the process according to the method known in the art. To be more concrete, they were prepared in such a manner that a given amount of the spectral sensitization dye was added to water thermally controlled to be 27° C. and it was stirred at 3,500 rpm by making use of a high-speed dissolver for a period within the range of 30 to 120 minutes.

The dispersion of the above-mentioned selenium sensitizer was prepared in the following manner. Thus, 120 g of triphenylphosphine selenide was added to 30 kg of ethyl acetate kept at 50° C. and then so stirred as to be dissolved completely. On the other hand, 3.8 kg of photographic gelatin was dissolved in 38 kg of water and, thereto, an aqueous 25 wt % of sodium dodecylbenzene sulfonate was added. Next, these two solutions were mixed up and the resulting mixture was dispersed at 50° C. for 30 minutes by making use of a high-speed stirring disperser provided with a 10-cm dissolver at a dispersion blade speed of 40 m/sec. Thereafter, the remaining ethyl acetate was removed while a stirring was rapidly carried out under reduced pressure so that the ethyl acetate concentration could be not higher than 0.3 wt %. Then, the resulting dispersion was diluted by making use of pure water so as to make 80 kg. A part of the resulting dispersion was fractionally extracted so as to use for the above-mentioned experiment.

Preparation of Emulsion Layer Coating Solution

The following additives were added to each of the emulsions prepared in the above-mentioned manner.

| | |
|---|---|
| Compound (G) | 0.5 mg/m$^2$ |
| 2,6-bis(hydroxyamino)-4-diethylamino-1,3,5-triazine | 5 mg/m$^2$ |
| 1,1-Dimethylol-1-bromo-1-nitromethane | 70 mg/m$^2$ |
| t-butyl-catechol | 130 mg/m$^2$ |
| Polyvinyl pyrrolidone (having a molecular weight of 10,000) | 35 mg/m$^2$ |
| A styrene-maleic acid anhydride copolymer | 80 mg/m$^2$ |
| Sodium polystyrene sulfonate | 80 mg/m$^2$ |
| Trimethylol propane | 350 mg/m$^2$ |
| Diethylene glycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Colloidal silica (Ludox AM produced by du Pont, av. size: 0.013 μm) | 0.5 g/m$^2$ |
| Active methylene-containing polymeric latex (P-7) | 0.3 g/m$^2$ |
| Gelatin | 1.2 g/m$^2$. |

Preparation of Protective Layer:

| | |
|---|---|
| Gelatin | 0.8 g/m$^2$ |
| A matting agent comprising polymethyl methacrylate (having an area average particle-size of 7.0 μm) | 50 mg/m$^2$ |
| Hardener $(CH_2{=}CHSO_2CH_2)_2O$ in an amount giving a swelling degree of 200% | |
| Sodium 2,4-dichloro-6-hydroxy-1,3,5-triazine | 10 mg/m$^2$ |
| Polyacrylamide (having an average molecular weight of 10000) | 0.2 g/m$^2$ |
| Sodium polyacrylate | 30 mg/m$^2$ |
| Polysiloxane (S1) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| Compound (F-1) | 3 mg/m$^2$ |
| Compound (F-2) | 2 mg/m$^2$ |
| Compound (F-3) | 1 mg/m$^2$ |
| Compound represented by formula (2) Table 5, 6 or 8 | |

The amounts of the raw materials provided were for one side use, and the amounts of silver provided were each adjusted to be 1.6 g/m$^2$ for one side use.

Preparation of Filter Layer:

On the both sides of a support of a blue-tinted polyethylene terephthalate film for X-ray use (having a thickness of 175 μm) which was coated with a sublayer comprising copolymer of glycidyl methaacrylate of 50 wt. %, methyl methacrylate of 10 wt. % and butyl methacrylate of 40 wt. %, the following cross-over have light shielding layer was coated so as to have the following composition.

| | |
|---|---|
| Solid fine-grain dispersion of dye (AH) | 50 mg/m$^2$ |
| Gelatin | 0.2 g/m$^2$ |
| Sodium dodecylbenzene sulfonate | 5 mg/m$^2$ |
| Compound (I) | 5 mg/m$^2$ |
| Sodium 2,4-dichloro-6-hydroxy-1,3,5-triazine | 5 mg/m$^2$ |
| Colloidal silica (having an average particle-size of 0.014 μm) | 10 mg/m$^2$ |
| Poly(potassium stylenesulfonate) | 50 mg/m$^2$ |

Compound (G)

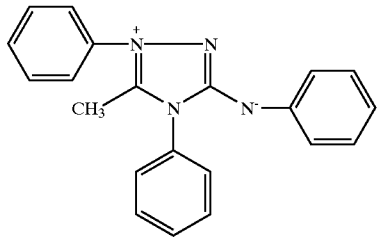

Compound (H)

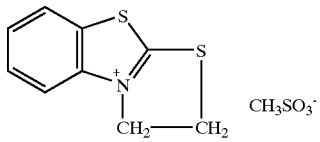

Compound (I)

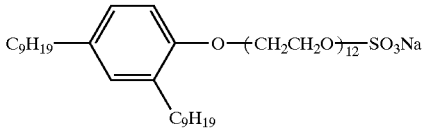

Compound (J)

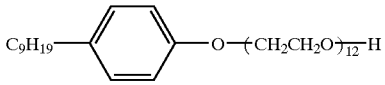

Compound (K)

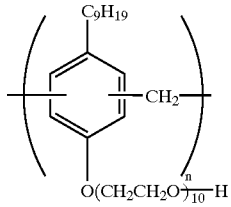

(Mixture of n = 2 to 5)

Compound (S-1)

-continued

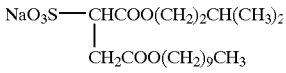

Compound (S-2)

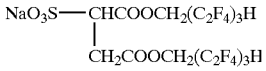

Polysiloxane (S1)

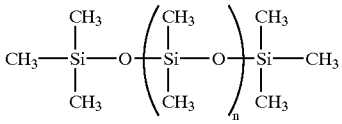

n ≈ ~1000

Solid fine particle dispersed dye (AH)

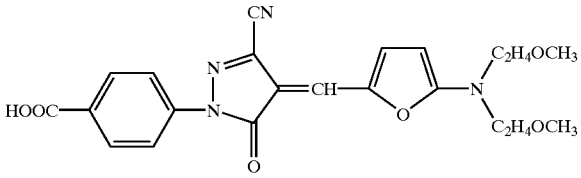

Compound (O)

$C_{11}H_{23}CONH(CH_2CH_2O)_5H$

Compound (M)

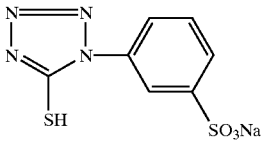

Compound (N)

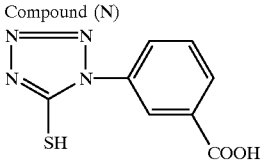

Compound (F-1)

Compound (F-2)

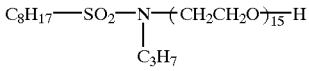

Compound (F-3)

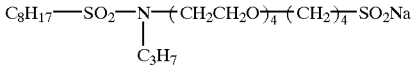

Coating:

These coating solutions were simultaneously coated on both sides of the support in amounts of silver of 1.6 g/m$^2$ and gelatin of 2.5 g/m$^2$, respectively, each per one side of support, using a slide hopper type coating machine at a speed of 120 per min. so as to have the following layer constitution; and dried for 2 min. 20 sec. Thus coated samples were prepared.

| Layer position | Kind of layer |
|---|---|
| Upper layer | Protective layer |
| Intermediate layer | Emulsion layer |
| Lower layer | Filter layer |

Preparation of Solid Developing Composition

Granules (A):

Sodium metabisulfite of 1050 g, 1-phenyl-3-pyrazolidone of 450 g, sodium erythorbate monohydrate, as a compound represented by formula (6) of 7200 g, binder D-sorbit of 810 g and N-acetyl-DL-penicillamine of 7 g were mixed for 3 min. in the stirring granulator commercially available and the resulting mixture was granulated for 1 min. at room temperature by adding 150 ml of water. The resulting granules were dried up at 50° C. for 2 hr. in a fluidized bed drier so that the moisture content of the granules was almost completely removed off.

Granules (B):

Potassium carbonate of 9500 g and potassium iodide of 6 g each were pulverized up in a commercially available mill so as to have an average particle size of 10 μm. To the resulting fine particles, was added DTPA. 5Na of 170 g, sodium sulfite of 425 g, sodium 5-mercapto-(1H)-tetrazolylacetate of 8.3 g, sodium 1-(3-sulfophenyl)-5-tetrazole of 40 g and binder D-mannit of 1500 g were added and the mixture was mixed for 3 min. in the stirring granulator commercially available and the resulting mixture was granulated for 1 min. at room temperature by adding 125 ml of water. The resulting granules were dried up at 40° C. for 2 hr. in a fluidized bed drier so that the moisture content of the granules was almost completely removed off.

To the thus prepared granules (A) was added sodium 1-octanesulfonate of 1%, based of the total weight and mixed by making use of a mixer in a room controlled to be not higher than 25° C. and 40% RH. Similarly, to the granules (B) was added sodium 1-octanesulfonate of 1.2%, based of the total weight and mixed by making use of a mixer in a room controlled to be not higher than 25° C. and 40% RH. Each of the mixtures was compression-tableted so as to have a filling amount of 10 g per tablet, by making use of a tableting machine that was modified model of Tough Press Collect 1527HU manufactured by Kikusui Mfg. Works, Inc to obtain developer compositions (A) and (B) in the form of a tablet for use in development. The filling ratio of the tablet (A) and (B) were 8.45 g and 12.4 g per tablet, respectively. Using a packaging material having the moisture-proof layer constitution described below, 60 tablets (A) and 50 tablets (B) were packaged (which were to be dissolved to form 5 lit. solution). The packaging material was a bag made of laminated material comprised of biaxially stretched nylon (ONY) of 15 μm thick/aluminum oxide-deposited PET of 12 μm thick/biaxially stretched polypropylene (OPP) of 25 μm thick/low density polyethylene (LLDP) of 40 μm thick. The packaging bag had an effective inner area in contact with the tablets of 1300 cm$^2$.

Preparation of Solid Fixing Composition

Granules (C):

Ammonium thiosulfate/sodium thiosulfate (90/10 by weight) of 14580 g was pulverized up in a commercially available mill so as to have an average particle size of 10 μm. To the resulting fine particles, were added compound (01), HO—$CH_2CH_2$—S—$CH_2CH_2$—S—$CH_2CH_2$—OH of 1000 g, sodium metabisulfite of 920 g, 5-mercaptotetrazole of 50 g and binder, Pineflow 900 g and the mixture was mixed in the mill for 3 min. in stirring granulator commercially available. The resulting mixture was granulated for 1 min. by adding 150 ml of water. The resulting granules were dried up at 40° C. in a fluidized bed drier so that the moisture content of the granules was almost completely removed off.

Granules (D):

Sodium gluconate of 250 g, aluminum sulfate octadecahydrate of 1500 g, cinnamic acid of 1150 g, tartaric acid of 250 g, mannit of 208 g and D-sorbit of 100 g each were pulverized, mixed and, in stirring granulator commercially available, the resulting mixture was granulated for 1 min. by adding 150 ml of water. The resulting granules were dried up at 40° C. in a fluidized bed drier so that the moisture content of the granules was almost completely removed off.

To the thus prepared granules (C) were added sodium acetate of 1400 g and sodium 1-hexanesulfonate of 1%, based of the total weight and the mixture was mixed by making use of a mixer in a room controlled to be not higher than 25° C. and 40% RH. Similarly, to the granules (D) were added sodium acetate of 1400 g and sodium 1-hexanesulfonate of 2.5%, based of the total weight and the mixture was mixed by making use of a mixer in a room controlled to be not higher than 25° C. and 40% RH. Each of the mixtures was compression-tableted so as to have a filling amount of 10 g per tablet, by making use of a tableting machine that was modified model of Tough Press Collect 1527HU manufactured by Kikusui Mfg. Works, Inc to obtain developer compositions (C) and (D) in the form of a tablet for use in development. The filling ratio of the tablet (C) and (D) were 10.5 g and 8.95 g per tablet, respectively. Using a packaging material having the moisture-proof layer constitution described below, 92 tablets (C) and 28 tablets (D) were packaged (which were to be dissolved to form 5 lit. solution).

Starter for Developer (per 1 lit. Developer Solution)

| | |
|---|---|
| N-acetyl-DL-penicillamine | 0.11 g |
| Diethylene glycol | 48.5 g |
| Compound (01) | 0.07 g |
| Sodium 5-mercapto-(1H)-tetrazolylacetate | 0.12 g |
| 90% Acetic acid | 11.5 g |
| KBr | 8.0 g |
| Water to make | 67 ml |

An automatic processor, SRX-701 (available from Konica Corp.) was modified in which a chemical mixer was provided to dissolve the solid processing composition. Prior to the start of processing, 13.5 lit. developer solution which was prepared by dissolving tablets of the developer composition was put in the developer tank, the starter described above was further added thereto to make a staring developer solution and developing was allowed to start. The starter was added in an amount of 67 ml/lit. developer solution. Similarly prepared 13.5 lit. fixer solution was put in the fixing tank of SRX-701 to employ it as a fixer starting solution.

Opened package of solid developing or fixing composition tablets was set at the inlet for the compositions and at the same time when the tablets was supplied into the tank, warm water (25 to 30° C.) was also introduced to prepare the processing solution of 5.0 lit., with stirring and dissolving for 25 min. The pH of the resulting developing solution was 10.23 and the pH was 9.90 when the starter was added. The fixing solution was 4.63 when dissolved. The built-in chemical mixer was separated to a solution-making tank of 5.0 lit volume and auxiliary tank of 5.0 lit. volume. The auxiliary was so provided that the replenishing solutions were able to be supplied even when the replenishing solution prepared in the solution-making tank was exhausted during processing, or during the dissolving time (ca. 25 min.).

Evaluation was made, using an automatic processor which was modification of above-described SRX-701 (available from Konica Corp.), in which the total processing time was 30 sec. at a developing temperature of 35° C. (and a replenishing rate of 180 ml/m$^2$), fixing temperature of 35° C. (and a replenishing rate of 180 ml/m$^2$). a washing water temperature of 18° C. (of 5 lit./min.) and a drying temperature of 55° C.

Sensitometric Evaluation

The prepared samples each were laminated with fluorescent intensifying screens XG-S (available from Konica Corp.) and exposed to X-ray under the conditions of a tube voltage of 90 kVp, current of 20 mA and a period of 0.05 sec., and according to the distance method, sensitometry curve was prepared to determine sensitivity and fog. The sensitivity was determined as a reciprocal of an X-ray exposure amount necessary to give a density of fog plus 1.0 and represented as a relative value, based on the sensitivity of the film using Em-1-1 being 100.

Processability Evaluation

Processed samples were evaluated with respect to the following items.

Evaluation of Silver Image Tone

Samples were each exposed to X-ray so as to give a density of 1.2, and processed using the processor. Processed samples were each observed on the viewing box and tone (color) of transmission-type silver images was visually evaluated, based on the following criteria:

5: Neutral black

4: Slightly reddish black

3: Reddish black

2: Slightly yellowish black

1: Yellowish black

Evaluation of Development Evenness

Samples of 10×12 inch size were each subjected to overall exposure so as to give a density of 1.0, and processed using the processor. Processed samples were also visually evaluated with respect to unevenness of developed silver images (uneven density), based on the following criteria:

5: No unevenness observed

4: Slight unevenness observed.

3: Weak uneveness observed (acceptable to practice

2: Marked unevenness observed (unacceptable to practice)

1: Overall unevenness observed

In the above, 3 or more, preferably 4 or more are acceptable levels in practice.

Evaluation of Roller Mark

Pressure marks (or roller marks) due to an automatic processor were evaluated according to the following procedure. Each sample was cut to 12.25×30.5 cm size and subjected to overall exposure so as to give a density of ca. 1.0 and processed in a manner similar to sensitometry. Roller marks occurred during processing were visually observed and evaluated based on the following criteria:

5: No roller mark observed,

4: Roller marks slightly occurred,

3: Roller marks occurred but acceptable to practice,

2: Many roller marks occurred, unacceptable to practice,

1: Marked roller marks occurred

Evaluation of Remaining Color Stain

Unexposed samples of 10×12 inch size were each processed in a manner similar to sensitometry, observed on the viewing box through transmitted light and remaining color stain was visually evaluated, based on the following criteria:

A: No stain observed and superior,

B: Slightly remaining color stain observed,

C: Weak color stain observed but acceptable level,

D: Markedly remaining color stain observed and unacceptable level.

TABLE 1

| Emulsion | | Mean Intergrain Distance | Mean Aspect Ratio | Metal Doping Metal | Metal Doping Add Time | Metal Doping Add. Form | Mean Grain Thickness (μm) | Mean Grain Diameter (μm) | Sensitometry Fog | Sensitometry S*1 | Processing Performance Roller Mark | Processing Performance Even-ness | Processing Performance Stain |
|---|---|---|---|---|---|---|---|---|---|---|---|---|---|
| Em-1-1 | Comp. | 1.00–1.20 | 6.0 | — | — | — | 0.19 | 1.14 | 0.09 | 100 | 3 | 3 | D |
| Em-1-2 | Comp. | 1.00–1.20 | 6.0 | SET-2 | (1)*2 | (4)*3 | 0.19 | 1.14 | 0.22 | 78 | 3 | 3 | D |
| Em-1-3 | Comp. | 1.00–1.20 | 6.0 | SET-2 | (1) | (5) | 0.19 | 1.14 | 0.25 | 57 | 3 | 3 | D |
| Em-1-4 | Comp. | 1.00–1.20 | 6.0 | SET-2 | (1) | (6) | 0.19 | 1.14 | 0.20 | 65 | 3 | 3 | D |
| Em-1-5 | Comp. | 1.00–1.20 | 6.0 | SET-2 | (2) | (4) | 0.19 | 1.14 | 0.31 | 50 | 2 | 2 | D |
| Em-1-6 | Comp. | 1.00–1.20 | 6.0 | SET-2 | (2) | (5) | 0.19 | 1.14 | 0.36 | 45 | 2 | 2 | D |
| Em-1-7 | Comp. | 1.00–1.20 | 6.0 | SET-2 | (2) | (6) | 0.19 | 1.14 | 0.29 | 55 | 2 | 3 | D |
| Em-1-8 | Comp. | 1.00–1.20 | 6.0 | SET-2 | (3) | (4) | 0.19 | 1.14 | 0.33 | 48 | 2 | 2 | D |
| Em-1-9 | Comp. | 1.00–1.20 | 6.0 | SET-2 | (3) | (5) | 0.19 | 1.14 | 0.35 | 45 | 1 | 2 | D |
| Em-1-10 | Comp. | 1.00–1.20 | 6.0 | SET-2 | (3) | (6) | 0.19 | 1.14 | 0.30 | 53 | 1 | 2 | D |
| Em-2-1 | Comp. | 1.00–1.06 | 9.4 | — | — | — | 0.15 | 1.42 | 0.05 | 105 | 3 | 3 | D |
| Em-2-2 | Comp. | 1.00–1.06 | 9.4 | SET-2 | (1) | (4) | 0.15 | 1.42 | 0.19 | 80 | 3 | 3 | D |
| Em-2-3 | Inv. | 1.00–1.06 | 9.4 | SET-2 | (1) | (5) | 0.15 | 1.42 | 0.04 | 139 | 5 | 4 | B |
| Em-2-4 | Inv. | 1.00–1.06 | 9.4 | SET-2 | (1) | (6) | 0.15 | 1.42 | 0.04 | 119 | 5 | 4 | B |
| Em-2-5 | Comp. | 1.00–1.06 | 9.4 | SET-2 | (2) | (4) | 0.15 | 1.42 | 0.16 | 82 | 2 | 3 | D |
| Em-2-6 | Inv. | 1.00–1.06 | 9.4 | SET-2 | (2) | (5) | 0.15 | 1.42 | 0.04 | 141 | 5 | 4 | B |
| Em-2-7 | Inv. | 1.00–1.06 | 9.4 | SET-2 | (2) | (6) | 0.15 | 1.42 | 0.05 | 121 | 5 | 4 | B |
| Em-2-8 | Comp. | 1.00–1.06 | 9.4 | SET-2 | (3) | (4) | 0.15 | 1.42 | 0.17 | 82 | 2 | 3 | C |
| Em-2-9 | Inv. | 1.00–1.06 | 9.4 | SET-2 | (3) | (5) | 0.15 | 1.42 | 0.04 | 145 | 4 | 4 | B |
| Em-2-10 | Inv. | 1.00–1.06 | 9.4 | SET-2 | (3) | (6) | 0.15 | 1.42 | 0.05 | 128 | 4 | 4 | B |

*1S: Sensitivity
*2A metal compound was added
(1) before ammonia ripening,
(2) during grain growth-1 or
(3) during grain growth-2.
*3A metal compound was added in the form of
(4) an aqueous solution,
(5) AgI fine grains or
(6) AgBr fine grains.

TABLE 2

| Emulsion | | Mean Intergrain Distance | Mean Aspect Ratio | Metal Doping Metal | Metal Doping Add Time | Metal Doping Add. Form | Mean Grain Thickness (μm) | Mean Grain Diameter (μm) | Sensitometry Fog | Sensitometry S*1 | Processing Performance Roller Mark | Processing Performance Even-ness | Processing Performance Stain |
|---|---|---|---|---|---|---|---|---|---|---|---|---|---|
| Em-3-1 | Comp. | 0.70–1.00 | 8.8 | — | — | — | 0.14 | 1.23 | 0.05 | 103 | 3 | 3 | C |
| Em-3-2 | Comp. | 0.70–1.00 | 8.8 | SET-2 | (1)*2 | (4)*3 | 0.14 | 1.23 | 0.18 | 76 | 3 | 2 | C |
| Em-3-3 | Inv. | 0.70–1.00 | 8.8 | SET-2 | (1) | (5) | 0.14 | 1.23 | 0.03 | 130 | 5 | 4 | B |
| Em-3-4 | Inv. | 0.70–1.00 | 8.8 | SET-2 | (1) | (6) | 0.14 | 1.23 | 0.04 | 111 | 5 | 4 | B |
| Em-3-5 | Comp. | 0.70–1.00 | 8.8 | SET-2 | (2) | (4) | 0.14 | 1.23 | 0.15 | 81 | 2 | 2 | C |
| Em-3-6 | Inv. | 0.70–1.00 | 8.8 | SET-2 | (2) | (5) | 0.14 | 1.23 | 0.04 | 133 | 5 | 4 | B |
| Em-3-7 | Inv. | 0.70–1.00 | 8.8 | SET-2 | (2) | (6) | 0.14 | 1.23 | 0.04 | 119 | 5 | 4 | B |
| Em-3-8 | Comp. | 0.70–1.00 | 8.8 | SET-2 | (3) | (4) | 0.14 | 1.23 | 0.15 | 82 | 2 | 2 | C |
| Em-3-9 | Inv. | 0.70–1.00 | 8.8 | SET-2 | (3) | (5) | 0.14 | 1.23 | 0.05 | 138 | 4 | 4 | B |
| Em-3-10 | Inv. | 0.70–1.00 | 8.8 | SET-2 | (3) | (6) | 0.14 | 1.23 | 0.06 | 122 | 4 | 4 | B |
| Em-4-1 | Comp. | 0.50–1.00 | 3.8 | — | — | — | 0.26 | 0.99 | 0.05 | 96 | 3 | 3 | C |
| Em-4-2 | Comp. | 0.50–1.00 | 3.8 | SET-2 | (2) | (4) | 0.26 | 0.99 | 0.14 | 79 | 3 | 3 | C |
| Em-4-3 | Inv. | 0.50–1.00 | 3.8 | SET-2 | (2) | (5) | 0.26 | 0.99 | 0.03 | 128 | 5 | 4 | B |
| Em-4-4 | Inv. | 0.50–1.00 | 3.8 | SET-2 | (2) | (6) | 0.26 | 0.99 | 0.04 | 111 | 5 | 4 | B |
| Em-4-5 | Comp. | 0.50–1.00 | 3.8 | SET-2 | (3) | (4) | 0.26 | 0.99 | 0.16 | 74 | 3 | 2 | C |
| Em-4-6 | Inv. | 0.50–1.00 | 3.8 | SET-2 | (3) | (5) | 0.26 | 0.99 | 0.04 | 131 | 5 | 4 | B |
| Em-4-7 | Inv. | 0.50–1.00 | 3.8 | SET-2 | (3) | (6) | 0.26 | 0.99 | 0.04 | 115 | 5 | 4 | B |

*1S: Sensitivity
*2A metal compound was added
(1) before ammonia ripening,
(2) during grain growth-1 or
(3) during grain growth-2.
*3A metal compound was added in the form of
(4) an aqueous solution,
(5) AgI fine grains or
(6) AgBr fine grains.

TABLE 3

| Emulsion | | Compound (1) (mg/m$^2$) | Metal Doping | | | Sensitometry | | Processing Performance | | |
|---|---|---|---|---|---|---|---|---|---|---|
| | | | Metal | Add Time | Add. Form | Fog | Sensitivity | Roller Mark | Evenness | Stain |
| Em-1-1 | Comp. | 1-2 (60) | — | — | — | 0.09 | 100 | 3 | 3 | D |
| Em-1-2 | Comp. | 1-2 (60) | SET-2 | (1)*1 | (4)*2 | 0.22 | 78 | 3 | 3 | D |
| Em-1-3 | Comp. | 1-2 (60) | SET-2 | (1) | (5) | 0.25 | 57 | 3 | 3 | D |
| Em-1-4 | Comp. | 1-2 (60) | SET-2 | (1) | (6) | 0.20 | 65 | 3 | 3 | D |
| Em-1-5 | Comp. | 1-2 (60) | SET-2 | (2) | (4) | 0.31 | 50 | 2 | 2 | D |
| Em-1-6 | Comp. | 1-2 (60) | SET-2 | (2) | (5) | 0.36 | 45 | 2 | 2 | D |
| Em-1-7 | Comp. | 1-2 (60) | SET-2 | (2) | (6) | 0.29 | 55 | 2 | 3 | D |
| Em-1-8 | Comp. | 1-2 (60) | SET-2 | (3) | (4) | 0.33 | 48 | 2 | 2 | D |
| Em-1-9 | Comp. | 1-2 (60) | SET-2 | (3) | (5) | 0.35 | 45 | 1 | 2 | D |
| Em-1-10 | Comp. | 1-2 (60) | SET-2 | (3) | (6) | 0.30 | 53 | 1 | 2 | D |
| Em-2-1 | Comp. | 1-2 (60) | — | — | — | 0.05 | 105 | 3 | 3 | D |
| Em-2-2 | Comp. | 1-2 (60) | SET-2 | (1) | (4) | 0.19 | 80 | 3 | 3 | C |
| Em-2-3 | Inv. | 1-2 (60) | SET-2 | (1) | (5) | 0.04 | 129 | 5 | 5 | A |
| Em-2-4 | Inv. | 1-2 (60) | SET-2 | (1) | (6) | 0.04 | 119 | 5 | 5 | A |
| Em-2-5 | Comp. | 1-2 (60) | SET-2 | (2) | (4) | 0.16 | 82 | 2 | 3 | C |
| Em-2-6 | Inv. | 1-2 (60) | SET-2 | (2) | (5) | 0.04 | 134 | 5 | 5 | A |
| Em-2-7 | Inv. | 1-2 (60) | SET-2 | (2) | (6) | 0.05 | 121 | 5 | 5 | A |
| Em-2-8 | Comp. | 1-2 (60) | SET-2 | (3) | (4) | 0.17 | 82 | 2 | 3 | C |
| Em-2-9 | Inv. | 1-2 (60) | SET-2 | (3) | (5) | 0.04 | 137 | 4 | 5 | A |
| Em-2-10 | Inv. | 1-2 (60) | SET-2 | (3) | (6) | 0.05 | 128 | 4 | 5 | A |

*1A metal compound was added
(1) before ammonia ripening,
(2) during grain growth-1 or
(3) during grain growth-2.
*2A metal compound was added in the form of
(4) an aqueous solution,
(5) AgI fine grains or
(6) AgBr fine grains.

TABLE 4

| Emulsion | | Compound (1) (mg/m$^2$) | Metal Doping | | | Sensitometry | | Processing Performance | | |
|---|---|---|---|---|---|---|---|---|---|---|
| | | | Metal | Add Time | Add. Form | Fog | Sensitivity | Roller Mark | Evenness | Stain |
| Em-1-1 | Comp. | 1-4 (55) | — | — | — | 0.08 | 100 | 3 | 3 | D |
| Em-1-2 | Comp. | 1-4 (55) | SET-2 | (1)*1 | (4)*2 | 0.22 | 77 | 3 | 3 | D |
| Em-1-3 | Comp. | 1-4 (55) | SET-2 | (1) | (5) | 0.24 | 57 | 3 | 3 | D |
| Em-1-4 | Comp. | 1-4 (55) | SET-2 | (1) | (6) | 0.19 | 63 | 3 | 3 | D |
| Em-1-5 | Comp. | 1-4 (55) | SET-2 | (2) | (4) | 0.30 | 50 | 2 | 2 | D |
| Em-1-6 | Comp. | 1-4 (55) | SET-2 | (2) | (5) | 0.36 | 44 | 2 | 2 | D |
| Em-1-7 | Comp. | 1-4 (55) | SET-2 | (2) | (6) | 0.30 | 55 | 2 | 3 | D |
| Em-1-8 | Comp. | 1-4 (55) | SET-2 | (3) | (4) | 0.33 | 47 | 2 | 2 | D |
| Em-1-9 | Comp. | 1-4 (55) | SET-2 | (3) | (5) | 0.36 | 46 | 1 | 2 | D |
| Em-1-10 | Comp. | 1-4 (55) | SET-2 | (3) | (6) | 0.31 | 55 | 1 | 2 | D |
| Em-2-1 | Comp. | 1-4 (55) | — | — | — | 0.05 | 103 | 3 | 3 | D |
| Em-2-2 | Comp. | 1-4 (55) | SET-2 | (1) | (4) | 0.18 | 80 | 3 | 3 | C |
| Em-2-3 | Inv. | 1-4 (55) | SET-2 | (1) | (5) | 0.04 | 130 | 5 | 5 | A |
| Em-2-4 | Inv. | 1-4 (55) | SET-2 | (1) | (6) | 0.05 | 120 | 5 | 5 | A |
| Em-2-5 | Comp. | 1-4 (55) | SET-2 | (2) | (4) | 0.15 | 85 | 2 | 3 | C |
| Em-2-6 | Inv. | 1-4 (55) | SET-2 | (2) | (5) | 0.04 | 132 | 5 | 5 | A |
| Em-2-7 | Inv. | 1-4 (55) | SET-2 | (2) | (6) | 0.05 | 124 | 5 | 5 | A |
| Em-2-8 | Comp. | 1-4 (55) | SET-2 | (3) | (4) | 0.18 | 85 | 3 | 3 | C |
| Em-2-9 | Inv. | 1-4 (55) | SET-2 | (3) | (5) | 0.04 | 135 | 5 | 5 | A |
| Em-2-10 | Inv. | 1-4 (55) | SET-2 | (3) | (6) | 0.05 | 127 | 5 | 5 | A |

*1A metal compound was added
(1) before ammonia ripening,
(2) during grain growth-1 or
(3) during grain growth-2.
*2A metal compound was added in the form of
(4) an aqueous solution,
(5) AgI fine grains or
(6) AgBr fine grains.

TABLE 5

| Emulsion | | Compound (1) (mg/m$^2$) | Metal Doping | | | Sensitometry | | Processing Performance | | |
|---|---|---|---|---|---|---|---|---|---|---|
| | | | Metal | Add Time | Add. Form | Fog | Sensitivity | Roller Mark | Evenness | Stain |
| Em-1-1 | Comp. | A-1 (0.8) | — | — | — | 0.10 | 100 | 3 | 3 | D |
| Em-1-2 | Comp. | A-1 (0.8) | SET-2 | (1)*1 | (4)*2 | 0.23 | 75 | 3 | 3 | D |
| Em-1-3 | Comp. | A-1 (0.8) | SET-2 | (1) | (5) | 0.26 | 55 | 3 | 3 | D |
| Em-1-4 | Comp. | A-1 (0.8) | SET-2 | (1) | (6) | 0.21 | 66 | 3 | 3 | D |
| Em-1-5 | Comp. | A-1 (0.8) | SET-2 | (2) | (4) | 0.31 | 53 | 2 | 2 | D |
| Em-1-6 | Comp. | A-1 (0.8) | SET-2 | (2) | (5) | 0.37 | 47 | 2 | 2 | D |
| Em-1-7 | Comp. | A-1 (0.8) | SET-2 | (2) | (6) | 0.30 | 56 | 2 | 3 | D |
| Em-1-8 | Comp. | A-1 (0.8) | SET-2 | (3) | (4) | 0.31 | 49 | 2 | 2 | D |
| Em-1-9 | Comp. | A-1 (0.8) | SET-2 | (3) | (5) | 0.35 | 44 | 1 | 2 | D |
| Em-1-10 | Comp. | A-1 (0.8) | SET-2 | (3) | (6) | 0.31 | 55 | 1 | 2 | D |
| Em-2-1 | Comp. | A-1 (0.8) | — | — | — | 0.06 | 105 | 3 | 4 | D |
| Em-2-2 | Comp. | A-1 (0.8) | SET-2 | (1) | (4) | 0.19 | 82 | 3 | 3 | C |
| Em-2-3 | Inv. | A-1 (0.8) | SET-2 | (1) | (5) | 0.04 | 136 | 5 | 5 | A |
| Em-2-4 | Inv. | A-1 (0.8) | SET-2 | (1) | (6) | 0.04 | 122 | 5 | 5 | A |
| Em-2-5 | Comp. | A-1 (0.8) | SET-2 | (2) | (4) | 0.18 | 80 | 2 | 3 | C |
| Em-2-6 | Inv. | A-1 (0.8) | SET-2 | (2) | (5) | 0.04 | 140 | 5 | 5 | A |
| Em-2-7 | Inv. | A-1 (0.8) | SET-2 | (2) | (6) | 0.04 | 122 | 5 | 5 | A |
| Em-2-8 | Comp. | A-1 (0.8) | SET-2 | (3) | (4) | 0.16 | 85 | 2 | 3 | C |
| Em-2-9 | Inv. | A-1 (0.8) | SET-2 | (3) | (5) | 0.04 | 144 | 5 | 5 | A |
| Em-2-10 | Inv. | A-1 (0.8) | SET-2 | (3) | (6) | 0.05 | 130 | 5 | 5 | A |

*1A metal compound was added
(1) before ammonia ripening,
(2) during grain growth-1 or
(3) during grain growth-2.
*2A metal compound was added in the form of
(4) an aqueous solution,
(5) AgI fine grains or
(6) AgBr fine grains.

TABLE 6

| Emulsion | | Compound (1) (mg/m$^2$) | Metal Doping | | | Sensitometry | | Processing Performance | | |
|---|---|---|---|---|---|---|---|---|---|---|
| | | | Metal | Add Time | Add. Form | Fog | Sensitivity | Roller Mark | Evenness | Stain |
| Em-1-1 | Comp. | A-15 (1.3) | — | — | — | 0.08 | 100 | 3 | 4 | D |
| Em-1-2 | Comp. | A-15 (1.3) | SET-2 | (1)*1 | (4)*2 | 0.21 | 80 | 3 | 3 | D |
| Em-1-3 | Comp. | A-15 (1.3) | SET-2 | (1) | (5) | 0.24 | 60 | 3 | 3 | D |
| Em-1-4 | Comp. | A-15 (1.3) | SET-2 | (1) | (6) | 0.20 | 67 | 3 | 3 | D |
| Em-1-5 | Comp. | A-15 (1.3) | SET-2 | (2) | (4) | 0.33 | 52 | 2 | 2 | D |
| Em-1-6 | Comp. | A-15 (1.3) | SET-2 | (2) | (5) | 0.37 | 47 | 2 | 2 | D |
| Em-1-7 | Comp. | A-15 (1.3) | SET-2 | (2) | (6) | 0.29 | 58 | 2 | 3 | D |
| Em-1-8 | Comp. | A-15 (1.3) | SET-2 | (3) | (4) | 0.35 | 50 | 2 | 2 | D |
| Em-1-9 | Comp. | A-15 (1.3) | SET-2 | (3) | (5) | 0.37 | 46 | 1 | 2 | D |
| Em-1-10 | Comp. | A-15 (1.3) | SET-2 | (3) | (6) | 0.29 | 55 | 1 | 2 | D |
| Em-2-1 | Comp. | A-15 (1.3) | — | — | — | 0.05 | 103 | 3 | 4 | D |
| Em-2-2 | Comp. | A-15 (1.3) | SET-2 | (1) | (4) | 0.22 | 78 | 3 | 3 | C |
| Em-2-3 | Inv. | A-15 (1.3) | SET-2 | (1) | (5) | 0.04 | 139 | 5 | 5 | A |
| Em-2-4 | Inv. | A-15 (1.3) | SET-2 | (1) | (6) | 0.04 | 121 | 5 | 5 | A |
| Em-2-5 | Comp. | A-15 (1.3) | SET-2 | (2) | (4) | 0.18 | 84 | 2 | 3 | C |
| Em-2-6 | Inv. | A-15 (1.3) | SET-2 | (2) | (5) | 0.04 | 144 | 5 | 5 | A |
| Em-2-7 | Inv. | A-15 (1.3) | SET-2 | (2) | (6) | 0.05 | 125 | 5 | 5 | A |
| Em-2-8 | Comp. | A-15 (1.3) | SET-2 | (3) | (4) | 0.19 | 80 | 3 | 3 | C |
| Em-2-9 | Inv. | A-15 (1.3) | SET-2 | (3) | (5) | 0.04 | 147 | 5 | 5 | A |
| Em-2-10 | Inv. | A-15 (1.3) | SET-2 | (3) | (6) | 0.05 | 130 | 5 | 5 | A |

*1A metal compound was added
(1) before ammonia ripening,
(2) during grain growth-1 or
(3) during grain growth-2.
*2A metal compound was added in the form of
(4) an aqueous solution,
(5) AgI fine grains or
(6) AgBr fine grains.

According to the present invention, there were achieved a method for preparing a silver halide tabular grain emulsion, which exhibits high sensitivity and produces no roller mark even when subjected to rapid processing at low replenishing rates, and a silver halide photographic material in which uneven development and stain due to remained sensitizing dye, even when developed in a developer containing no hardener.

Example 2

Solid granular processing compositions were prepared and using them, photographic material samples employed in Example 1 were processed to evaluate processability thereof.

Preparation of Granular Developer Kit (for 10 lit. Working Solution)

1) Preparation of Developing Agent Granules DA

Pre-treatment of Raw Material

Hydroquinone was pulverized using MIKRO-PULVERIZER AP-B (available from Hosokawa Mikron Corp.) at 8 mm mesh and 50 Hz revolution. 8-Mercaptoadenine was similarly pulverized using the pulverizer at 8 mm mesh and 50 Hz revolution. Using commercially available dressing machine, potassium bromide was subjected to dressing through 0.25 mm mesh.

Mixing of Raw Materials

Using a commercially available V-type mixer (200 lit. volume), the following formula was mixed for 15 min.

| | |
|---|---|
| Hydroquinone (pulverized above) | 42.57 kg |
| Sodium erythorbate | 10.64 kg |
| Dimezone S | 2.31 kg |
| 8-Mercaptoadenine (pulverized above) | 0.20 kg |
| DTPA. 5H | 7.09 kg |
| KBr (pulverized above) | 3.55 kg |
| Benzotriazole | 0.51 kg |
| Sorbitol | 3.14 kg |

Sampling of 50 g was made arbitrarily from any five portions of the mixture and it was confirmed that each component was within ±5% in concentration and uniformly mixed.

Briquetting

The obtained powdery mixture was molded into briquettes using a compression-type molding machine, Briquetta BSS IV-type (available from Shinto Kogyo Corp.) with a pocket form of 5.0 mmϕ×1.2 mm in depth and at a roller revolution of 15 rpm. and a feeder revolution of 24 rpm. The resulting tabular-formed composition was pulverized and classified into granules of 2.4 to 7.0 mm and fine powder of less than 2.4 mm. Granules of larger than 7.0 mm were further pulverized and the powder of less than 2.4 mm was mixed with the powdery mixture described above and molded again using the compression-type molding machine. There was obtained 68 kg of a developing agent granules, DA.

2) Preparation of Alkali Granules DB

Preparation of Raw Material

Raw materials were subjected to the pre-treatment.

In 400 ml of ethyl alcohol was dissolved 56.6 g of 1-phenyl-5-mercaptotetrazole. The resulting solution was dropwise added to 20 kg of anhydrous sodium carbonate with stirring by a rotating mixer. Rotation stirring continued until sufficiently dried. Sampling of 10 g was made arbitrarily from any five portions of the mixture and 1-phenyl-5-mercaptotetrazole was confirmed to be uniformly mixed. The obtained mixture was denoted as Mix-1.

Mixing of Potassium Carbonate and Mix-1

Using a commercially available V-type mixer (200 lit. volume), the following formula was mixed for 10 m in.

| | |
|---|---|
| Potassium carbonate | 14.85 kg |
| Mix-1 | 11.44 kg |
| Sodium sulfite anhydride | 35.85 kg |
| D-mannitol | 4.63 kg |
| D-Sorbitol | 1.86 kg |

Sodium 1-octanesulfonate which was previously pulverized using MIKRO-PULVERIZER AP-B (available from Hosokawa Mikron Corp.) at 4 mm mesh and 60 Hz revolution, was added to the mixture and mixing was further continued for 5 min.

Briquetting

The obtained powdery mixture was molded into briquettes using a compression-type molding machine, Briquetta BSS IV-type (available from Shinto Kogyo Corp.) with a pocket form of 5.0 mmϕ×1.2 mm in depth and at a roller revolution of 15 rpm. and a feeder revolution of 24 rpm. The resulting tabular-formed composition was pulverized and classified into granules of 2.4 to 7.0 mm and fine powder of less than 2.4 mm. Granules of larger than 7.0 mm were further pulverized and the powder of less than 2.4 mm was mixed with the powdery mixture described above and molded again using the compression-type molding machine. There was obtained 68 kg alkali granule DB.

Packaging (Kit for 10 lit. Working Solution)

Into a square-shaped tray (upper inner size of 15×15 inch and lower inner size of 14×14 inch), which was made of a polypropylene (PP) resin having moisture permeability of 0.5 $g/m^2 \cdot 24$ hrs. and oxygen permeability of 65 $ml/m^2 \cdot 24$ hrs., molded granules and $LiOH.H_2O$ were filled in the following order. After blowing 2.0 lit. of nitrogen gas inside the tray. the upper opening portion was sealed with polyethylene-coated aluminum foil using a heat sealer to obtain solid developer composition package D-1.

| | |
|---|---|
| 1) $LiOH \cdot H_2O$ | 103.8 g |
| 2) Alkali granule DB | 1174.9 g |
| 3) Developing agent granule DA | 355.2 g |
| Total weight | 1633.9 g |

Preparation of Processing Solution

Cutting out an aluminum pillow of the solid developer composition package D-1, the contents were taken out and added into 9 lit. of tap water with stirring for ca. 40 min. by means of a commercially available stirrer to obtain 10 lit. of developer solution DR with a pH of 10.70.

Preparation of Granular Fixer Kit (for 10 lit. Working Solution)

1) Preparation of Fixing Agent Granules FA

Pre-treatment of Raw Material

Sodium 1-octanesulfonate was pulverized using MIKRO-PULVERIZER AP-B (available from Hosokawa Mikron Corp.) at 4 mm mesh and 60 Hz revolution. Using commercially available dressing machine, ammonium thiosulfate (including 10% sodium salt) was subjected to dressing through 1.0 mm mesh. Similarly, anhydrous sodium acetate was subjected to dressing treatment through 0.5 mm mesh. With regard to the particle size, ammonium thiosulfate had a peak within the range of 710 to 850 $\mu$m, sodium acetate having a peak at 500 Wm.

Mixing of Raw Materials

Using a commercially available V-type mixer (200 lit. volume), the following formula was mixed for 10 min.

| | |
|---|---|
| Ammonium thiosulfate (including 10% sodium salt) | 49.68 kg |
| Sodium sulfite | 3.37 kg |
| Sodium metabisulfite | 5.31 kg |
| Anhydrous sodium acetate | 10.60 kg |

To the resulting mixture, 630 g of sodium 1-octanesulfonate was added and mixing was further continued for 5 min.

Briquetting

The obtained powdery mixture was molded into briquettes using a compression-type molding machine, Briquetta BSS IV-type (available from Shinto Kogyo Corp.) with a pocket form of 5.0 mmϕ×1.2 mm in depth and at a roller revolution of 25 rpm. and a feeder revolution of 36 rpm. The resulting tabular-formed composition was pulverized and classified into granules of 2.4 to 7.0 mm and fine powder of less than 2.4 mm. Granules of larger than 7.0 mm were further pulverized and the powder of less than 2.4 mm was mixed with the powdery mixture described above and molded again using the compression-type molding machine. There was obtained 69 kg fixing agent granule FA.

2) Preparation of Hardener Granule FB

Mixing of Raw Materials

Using a commercially available V-type mixer (200 lit. volume), the following formula was mixed for 10 min.

| | |
|---|---|
| Aluminum sulfate octahydrate | 41.42 kg |
| Sodium gluconate | 21.61 kg |
| D-Mannitol | 3.17 kg |
| D-Sorbitol | 3.17 kg |

To the resulting mixture, 630 g of sodium 1-octanesulfonate was added and mixing was further continued for 5 min.

Briquetting

The obtained powdery mixture was molded into briquettes using a compression-type molding machine, Briquetta BSS IV-type (available from Shinto Kogyo Corp.) with a pocket form of 5.0 mmϕ×1.2 mm in depth and at a roller revolution of 25 rpm. and a feeder revolution was so adjusted that the roll load voltage was 16 to 19 ampere. The resulting tabular-formed composition was pulverized and classified into granules of 2.4 to 7.0 mm and fine powder of less than 2.4 mm. Granules of larger than 7.0 mm were further pulverized and the powder of less than 2.4 mm was mixed with the powdery mixture described above and molded again using the compression-type molding machine. There was obtained 69 kg granule FB.

3) Preparation of Acid Granule FC

Mixing of Raw Materials

Using a commercially available V-type mixer (200 lit. volume), the following formula was mixed for 10 min.

| | |
|---|---|
| Tartaric acid | 12.96 kg |
| Succinic acid | 57.04 kg |

Briquetting

The obtained powdery mixture was molded into briquettes using a compression-type molding machine, Briquetta BSS IV-type (available from Shinto Kogyo Corp.) with a pocket form of 5.0 mmϕ×1.2 mm in depth and at a roller revolution of 25 rpm. and a feeder revolution was so adjusted that the roll load voltage was 16 to 19 ampere. The resulting tabular-formed composition was pulverized and classified into granules of 2.4 to 7.0 mm and fine powder of less than 2.4 mm. Granules of larger than 7.0 mm were further pulverized and the powder of less than 2.4 mm was mixed with the powdery mixture described above and molded again using the compression-type molding machine. There was obtained 70 kg granule FC.

Packaging (Kit for 10 lit. Working Solution)

Into a square-shaped tray (upper inner size of 15×15 inch and lower inner size of 14×14 inch), which was made of a polypropylene (PP) resin having moisture permeability of 0.5 g/m$^2$·24 hrs. and oxygen permeability of 65 ml/m$^2$·24 hrs., molded granules and $LiOH{\cdot}H_2O$ were filled in the following order. After blowing 2.0 lit. of nitrogen gas inside the tray. the upper opening portion was sealed with polyethylene-coated aluminum foil using a heat sealer to obtain solid developer composition package F-1.

| | |
|---|---|
| 1) Fixing agent granule FA | 1848.9 g |
| 2) Hardener granule FB | 162.0 g |
| 3) Acid granule FC | 194.4 g |
| Total weight | 2205.3 g |

Preparation of Processing Solution

Cutting out an aluminum pillow of the solid developer composition package F-1, the contents were taken out and added into 8.5 lit. of tap water with stirring for ca. 40 min. by means of a commercially available stirrer to obtain 10 lit. of fixer solution FR with a pH of 4.50.

Photographic material samples were evaluated with respect to sensitometry, silver image tone, development evenness, roller marks and remaining color stain, in the same manner as in Example 1, except that developer and fixer solutions were respectively replaced by developer and fixer solutions DR and FR described above. Results thereof are shown in Tables 7 and 8.

TABLE 7

| Emulsion | | Compound (1) (mg/m$^2$) | Metal Doping | | | Sensitometry | | Processing Performance | | |
|---|---|---|---|---|---|---|---|---|---|---|
| | | | Metal | Add Time | Add. Form | Fog | Sensitivity | Roller Mark | Evenness | Stain |
| Em-1-1 | Comp. | 1-2 (60) | — | — | — | 0.11 | 100 | 3 | 3 | D |
| Em-1-2 | Comp. | 1-2 (60) | SET-2 | (1)*1 | (4)*2 | 0.24 | 76 | 3 | 2 | D |
| Em-1-3 | Comp. | 1-2 (60) | SET-2 | (1) | (5) | 0.27 | 55 | 3 | 2 | D |
| Em-1-4 | Comp. | 1-2 (60) | SET-2 | (1) | (6) | 0.22 | 63 | 3 | 2 | D |
| Em-1-5 | Comp. | 1-2 (60) | SET-2 | (2) | (4) | 0.32 | 48 | 2 | 1 | D |
| Em-1-6 | Comp. | 1-2 (60) | SET-2 | (2) | (5) | 0.40 | 42 | 2 | 1 | D |
| Em-1-7 | Comp. | 1-2 (60) | SET-2 | (2) | (6) | 0.33 | 52 | 2 | 2 | D |

TABLE 7-continued

| Emulsion | | Compound (1) (mg/m$^2$) | Metal Doping | | | Sensitometry | | Processing Performance | | |
|---|---|---|---|---|---|---|---|---|---|---|
| | | | Metal | Add Time | Add. Form | Fog | Sensitivity | Roller Mark | Evenness | Stain |
| Em-1-8 | Comp. | 1-2 (60) | SET-2 | (3) | (4) | 0.35 | 45 | 2 | 1 | D |
| Em-1-9 | Comp. | 1-2 (60) | SET-2 | (3) | (5) | 0.37 | 42 | 1 | 1 | D |
| Em-1-10 | Comp. | 1-2 (60) | SET-2 | (3) | (6) | 0.32 | 50 | 1 | 1 | D |
| Em-2-1 | Comp. | 1-2 (60) | — | — | — | 0.07 | 107 | 3 | 3 | D |
| Em-2-2 | Comp. | 1-2 (60) | SET-2 | (1) | (4) | 0.20 | 83 | 3 | 2 | C |
| Em-2-3 | Inv. | 1-2 (60) | SET-2 | (1) | (5) | 0.05 | 130 | 5 | 5 | A |
| Em-2-4 | Inv. | 1-2 (60) | SET-2 | (1) | (6) | 0.05 | 120 | 5 | 5 | A |
| Em-2-5 | Comp. | 1-2 (60) | SET-2 | (2) | (4) | 0.17 | 84 | 2 | 2 | C |
| Em-2-6 | Inv. | 1-2 (60) | SET-2 | (2) | (5) | 0.05 | 137 | 5 | 5 | A |
| Em-2-7 | Inv. | 1-2 (60) | SET-2 | (2) | (6) | 0.05 | 130 | 5 | 5 | A |
| Em-2-8 | Comp. | 1-2 (60) | SET-2 | (3) | (4) | 0.18 | 85 | 3 | 2 | C |
| Em-2-9 | Inv. | 1-2 (60) | SET-2 | (3) | (5) | 0.05 | 141 | 5 | 5 | A |
| Em-2-10 | Inv. | 1-2 (60) | SET-2 | (3) | (6) | 0.05 | 135 | 5 | 5 | A |

*1A metal compound was added
(1) before ammonia ripening,
(2) during grain growth-1 or
(3) during grain growth-2.
*2A metal compound was added in the form of
(4) an aqueous solution,
(5) AgI fine grains or
(6) AgBr fine grains.

TABLE 8

| Emulsion | | Compound (1) (mg/m$^2$) | Metal Doping | | | Sensitometry | | Processing Performance | | |
|---|---|---|---|---|---|---|---|---|---|---|
| | | | Metal | Add Time | Add. Form | Fog | Sensitivity | Roller Mark | Evenness | Stain |
| Em-1-1 | Comp. | A-1 (0.8) | — | — | — | 0.08 | 100 | 3 | 3 | D |
| Em-1-2 | Comp. | A-1 (0.8) | SET-2 | (1)*1 | (4)*2 | 0.21 | 79 | 3 | 3 | D |
| Em-1-3 | Comp. | A-1 (0.8) | SET-2 | (1) | (5) | 0.23 | 59 | 3 | 3 | D |
| Em-1-4 | Comp. | A-1 (0.8) | SET-2 | (1) | (6) | 0.19 | 67 | 3 | 3 | D |
| Em-1-5 | Comp. | A-1 (0.8) | SET-2 | (2) | (4) | 0.27 | 51 | 2 | 2 | D |
| Em-1-6 | Comp. | A-1 (0.8) | SET-2 | (2) | (5) | 0.32 | 48 | 2 | 2 | D |
| Em-1-7 | Comp. | A-1 (0.8) | SET-2 | (2) | (6) | 0.26 | 57 | 2 | 3 | D |
| Em-1-8 | Comp. | A-1 (0.8) | SET-2 | (3) | (4) | 0.30 | 49 | 2 | 2 | D |
| Em-1-9 | Comp. | A-1 (0.8) | SET-2 | (3) | (5) | 0.32 | 47 | 2 | 2 | D |
| Em-1-10 | Comp. | A-1 (0.8) | SET-2 | (3) | (6) | 0.29 | 55 | 2 | 2 | D |
| Em-2-1 | Comp. | A-1 (0.8) | — | — | — | 0.05 | 107 | 3 | 2 | D |
| Em-2-2 | Comp. | A-1 (0.8) | SET-2 | (1) | (4) | 0.20 | 81 | 3 | 2 | C |
| Em-2-3 | Inv. | A-1 (0.8) | SET-2 | (1) | (5) | 0.04 | 136 | 5 | 5 | A |
| Em-2-4 | Inv. | A-1 (0.8) | SET-2 | (1) | (6) | 0.04 | 120 | 5 | 5 | A |
| Em-2-5 | Comp. | A-1 (0.8) | SET-2 | (2) | (4) | 0.16 | 85 | 2 | 2 | C |
| Em-2-6 | Inv. | A-1 (0.8) | SET-2 | (2) | (5) | 0.04 | 140 | 5 | 5 | A |
| Em-2-7 | Inv. | A-1 (0.8) | SET-2 | (2) | (6) | 0.05 | 131 | 5 | 5 | A |
| Em-2-8 | Comp. | A-1 (0.8) | SET-2 | (3) | (4) | 0.17 | 83 | 3 | 2 | C |
| Em-2-9 | Inv. | A-1 (0.8) | SET-2 | (3) | (5) | 0.04 | 142 | 5 | 5 | A |
| Em-2-10 | Inv. | A-1 (0.8) | SET-2 | (3) | (6) | 0.05 | 133 | 5 | 5 | A |

*1A metal compound was added
(1) before ammonia ripening,
(2) during grain growth-1 or
(3) during grain growth-2.
*2A metal compound was added in the form of
(4) an aqueous solution,
(5) AgI fine grains or
(6) AgBr fine grains.

From Tables 7 and 8, it is apparent that inventive samples exhibited superior effects.

What is claimed is:

1. A method of preparing a silver halide emulsion, wherein said silver halide emulsion comprises tabular grains exhibiting a mean equivalent circle diameter of 0.1 to 10.0 μm, a mean grain thickness of 0.01 to 0.3 μm and an aspect ratio of 1.5 to 300, the method comprising:

(a) reacting a silver salt solution and a halide salt solution to perform silver halide grain nucleation, followed by silver halide grain growth to form the tabular grains, wherein the tabular grains are formed in the presence of fine silver halide grains containing at least one selected from the group of gallium, indium and metals in Groups 8, 9 and 10 of the periodical table; and (b) removing a solution containing soluble salts from a reaction mixture solution by ultrafiltration during the silver halide grain growth to reduce the volume of the reaction mixture solution in a reaction vessel;

wherein in (b), the volume of the reaction mixture solution is so controlled that a mean intergrain distance as defined below in the reaction mixture solution in the reaction vessel is maintained within not less than 0.60 and not more than 1.15 times that at the start of the grain growth over a period of from start of growing silver halide grains to completion thereof:

mean intergrain distance=(Volume of the reaction mixture solution/number of grains in the reaction mixture solution)$^{1/3}$.

2. The method of claim 1, wherein said fine silver halide grains contain at least a metal selected from the group consisting of gallium, indium, iron, ruthenium, osmium, cobalt, rhodium, iridium, nickel, palladium and platinum.

3. The method of claim 1, wherein said fine silver halide grains have a grain size of 0.01 to 0.1 $\mu$m.

4. The method of claim 1, wherein said fine silver halide grains are introduced at a time during the grain growth to form dislocation lines in the tabular grains.

5. A method for preparing a silver halide photographic light-sensitive material comprising a support having thereon hydrophilic colloidal layers including a silver halide emulsion layer and a light-insensitive hydrophilic colloidal layer, wherein the silver halide emulsion layer contains a silver halide emulsion comprised of tabular grains exhibiting a mean equivalent circle diameter of 0.1 to 10.0 $\mu$, a mean grain thickness of 0.01 to 0.3 $\mu$m and an aspect ratio of 1.5 to 300; the method comprising:

(i) preparing the silver halide emulsion by a process comprising; (i-a) reacting a silver salt solution and a halide salt solution to perform silver halide grain nucleation, followed by silver halide grain growth to form the tabular grains, in which the tabular grains are formed in the presence of fine silver halide grains containing at least one selected from the group of indium, gallium and metals in Groups 8, 9 and 10 of the periodical table, and (i-b) removing a solution containing soluble salts from a reaction mixture solution by ultrafiltration during the silver halide grain growth to reduce the volume of the reaction mixture solution in a reaction vessel;

(ii) forming, on the support, the hydrophilic colloidal layers including the silver halide emulsion layer containing the silver halide emulsion prepared by the step (i), wherein at least one of the hydrophilic colloidal layers contains a compound represented by the following formula (1):

Formula (1)

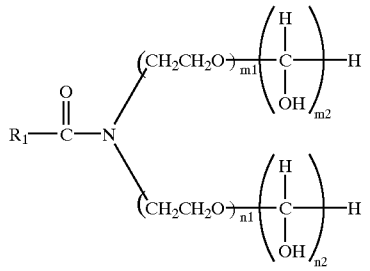

wherein $R_1$ represents a substituted or unsubstituted alkyl, alkenyl or aryl group, each containing 1 to 30 carbon atoms; ml and nl each are 1 to 50; and m2 and n2 each are 0 to 3.

6. The method of claim 5, wherein at least one of the hydrophilic colloidal layers contains a compound represented by the following formula (2):

Formula (2)

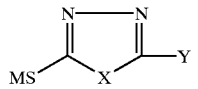

wherein X represents an oxygen or sulfur atom; Y represents a hydrogen atom or a substituent; M represents a hydrogen atom, an alkali metal ion, a quaternary ammonium ion or a quaternary phosphonium ion.

7. The method of claim 5, wherein at least a silver halide emulsion layer contains a latex derived from an ethylenically unsaturated monomer containing an active methylene group.

* * * * *